US010193230B2

(12) United States Patent
Hay

(10) Patent No.: US 10,193,230 B2
(45) Date of Patent: Jan. 29, 2019

(54) ENHANCED CONNECTED TILED ARRAY ANTENNA

(71) Applicant: Commonwealth Scientific and Industrial Research Organization, Campbell (AU)

(72) Inventor: Stuart Gifford Hay, Kogarah Bay (AU)

(73) Assignee: Commonwealth Scientific And Industrial Research Organisation, Campbell, Australian Capital Territory (AU)

( * ) Notice: Subject to any disclaimer, the term of this patent is extended or adjusted under 35 U.S.C. 154(b) by 106 days.

(21) Appl. No.: 14/388,795

(22) PCT Filed: Mar. 28, 2013

(86) PCT No.: PCT/AU2013/000315
§ 371 (c)(1),
(2) Date: Sep. 26, 2014

(87) PCT Pub. No.: WO2013/142905
PCT Pub. Date: Oct. 3, 2013

(65) Prior Publication Data

US 2015/0084827 A1 Mar. 26, 2015

(30) Foreign Application Priority Data

Mar. 29, 2012 (AU) ..... 2012901270

(51) Int. Cl.
*H01Q 9/04* (2006.01)
*H01Q 21/06* (2006.01)
(Continued)

(52) U.S. Cl.
CPC ..... *H01Q 9/0407* (2013.01); *H01Q 1/50* (2013.01); *H01Q 9/045* (2013.01);
(Continued)

(58) Field of Classification Search
CPC ..... H01Q 9/045; H01Q 21/065
See application file for complete search history.

(56) References Cited

U.S. PATENT DOCUMENTS 5,661,494 A * 8/1997 Bondyopadhyay .... H01Q 1/364 343/700 MS
6,426,722 B1 * 7/2002 Sievenpiper ..... H01Q 15/10 343/700 MS
(Continued)

FOREIGN PATENT DOCUMENTS

CN 1322390 11/2001
CN 101944654 1/2011
(Continued)

OTHER PUBLICATIONS

International Search Report for PCT/AU2013/000315 dated Jul. 24, 2013.
(Continued)

*Primary Examiner* — Dameon E Levi
*Assistant Examiner* — Hasan Z Islam
(74) *Attorney, Agent, or Firm* — Ladas & Parry, LLP

(57) ABSTRACT

An antenna device including: a conductive ground sheet of a substantially planar form; and a series of spaced apart conductive patches arranged substantially in a plane parallel to the conductive ground plane; a series of conductive feed interconnections electromagnetically coupled to the spaced apart array of conductive patches.

16 Claims, 26 Drawing Sheets

(51) Int. Cl.
*H01Q 1/50* (2006.01)
*H01Q 21/00* (2006.01)

(52) U.S. Cl.
CPC ..... *H01Q 9/0457* (2013.01); *H01Q 21/0006* (2013.01); *H01Q 21/065* (2013.01)

(56) References Cited

U.S. PATENT DOCUMENTS

| | | | | |
|---|---|---|---|---|
| 7,079,079 | B2 * | 7/2006 | Jo | H01Q 1/243 343/700 MS |
| 7,315,288 | B2 | 1/2008 | Livingston | |
| 8,354,975 | B2 * | 1/2013 | Ando | H01Q 9/0421 333/202 |
| 2002/0047802 | A1 | 4/2002 | Voipio | |
| 2003/0197658 | A1 * | 10/2003 | Lilly | H01Q 1/243 343/909 |
| 2008/0204327 | A1 * | 8/2008 | Lee | H01Q 1/38 343/700 MS |

FOREIGN PATENT DOCUMENTS

| | | |
|---|---|---|
| CN | 102110903 | 6/2011 |
| JP | 57-176808 | 10/1982 |
| JP | 1-103302 | 4/1989 |
| JP | 2002-530909 | 9/2002 |
| JP | 2004-221964 | 8/2004 |
| WO | 00/30213 | 5/2000 |
| WO | 2009/128716 A1 | 10/2009 |
| WO | 2012/003546 | 1/2012 |

OTHER PUBLICATIONS

Extended European Search Report dated Nov. 10, 2015 for European Patent Application No. 13769373.5.

Limbach M Ed—European Space Agency ESA: "Design of an Airborne Dual-Polarized Triple Stacked Patch Antenna for Broadband SAR Application in P-Band", 25th. ESA Antenna Workshop on Satellite Antenna Technology. Noordwijk, The Netherlands, Sep. 18-20, 2002; [ESA Antenna Workshop on Satellite Antenna Technology], NL, Noordwijk : ESA, Sep. 18, 2002 (Sep. 18, 2002), pp. 513-518, XP001128860).

Herscivici N I et al: "Analysis and Design of Multilayer Printed Antennas: A Modular Approach", IEEE Transactions on Antennas and Propagation, IEEE Service Center, Piscataway, NJ, US, vol. 41, No. 10, Oct. 1, 1993 (Oct. 1, 1993), pp. 1371-1378, XP000414499, ISSN: 0018-926X, DOI: 10.1109/8.247777.

Office Action dated Jan. 25, 2016 for Chinese Patent Application No. 201380028763.0 and its English translation provided by Applicant's foreign counsel.

International Preliminary Report on Patentability (Chapter I) for PCT/AU2013/000315 dated Oct. 1, 2014.

Written Opinion of the International Searching Authority for PCT/AU2013/000315 dated Jul. 24, 2013.

Office Action dated Jun. 28, 2017 for Chinese Patent Application No. 201380028763.0 and its English translation by Global Dossier.

Office Action dated Aug. 8, 2017 for Australian Patent Application No. 2013239324.

Office Action dated Sep. 25, 2017 for Japanese Patent Application No. 2015-502018 and its English translation provided by Applicant's foreign counsel.

* cited by examiner

Impedance of modified array (s=13mm, gap capacitance C=2pF) in series with 10pF capacitance at array terminals.

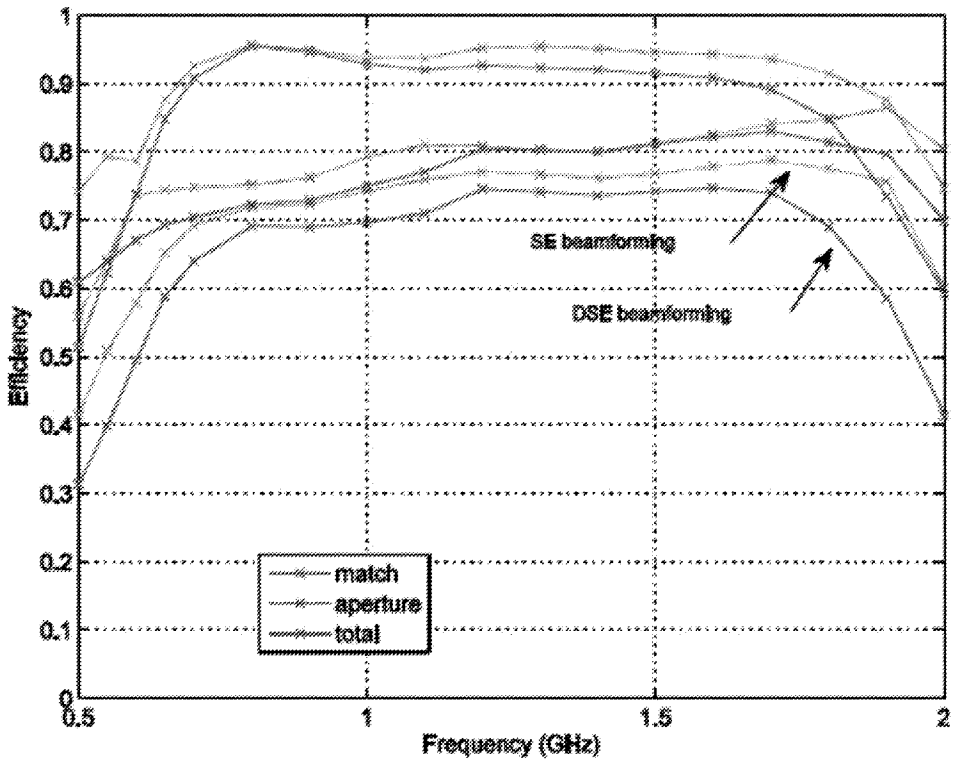

Fig. 11: Efficiencies of 5x4 array with conducting tubes around feed conductors. s=13mm, l=50mm, added gap capacitance C=1.2pF and array ports terminated in single-ended impedance of z0=100ohm. Results are shown for single-ended (SE) and differential-single-ended (DSE) beamforming of the array signals when illuminated by the focal-region field of a paraboloidal reflector with focal-length-to-diameter ratio of 0.5.

Fig. 14

: Impedance of 5x4 array with conducting tubes around feed conductors.

: Optional modification to the array with groundplane extension part containing holes for passage of feed conductors to allow connection to electrical circuits and an optional slot to add inductance to the array impedance at high frequency.

: Array and LNA minimum-noise impedances. s=13mm, C=1.5pF, h=30mm.

Noise and signal-to-noise ratio parameters associated with a 5x4 array when driven by the focal-region field of a paraboloidal reflector with focal-length-to-diameter ratio of 0.5.

ENHANCED CONNECTED TILED ARRAY ANTENNA

CROSS-REFERENCE TO RELATED APPLICATIONS

This application is the U.S. National Stage of International Patent Application No. PCT/AU2013/000315, filed on Mar. 28, 2013, which claims priority to Australian Patent Application No. 2012901270, filed on Mar. 29, 2012, the disclosures of which are hereby incorporated by reference in their entireties.

FIELD OF THE INVENTION

The present invention relates to the field of antenna devices and, in particular, discloses an improved form of antenna construction.

BACKGROUND

Any discussion of the background art throughout the specification should in no way be considered as an admission that such art is widely known or forms part of common general knowledge in the field.

Antenna transmitting and receiving systems can take many forms. One form of system is illustrated in FIG. 1 and is known as a parabolic dish type antenna. The antenna 1 includes a parabolic dish 2 which acts to concentrate or focus signals at a focal point 3 where the transmitter/receiver 3 is located.

Many different types of transmitter/receiver are known. For example, Patent Cooperation Treaty Patent Application: PCT/AU2011/000862 entitled "Reconfigurable Self Complementary Array" discloses one form of "checkerboard array" of transmitter/receivers of a self complementary form suitable for use in many applications. Such a checkerboard array is suitable for many uses including in a large receiver network of transmitter/receivers such as that proposed in the Square Kilometer Array (SKA) project.

The checkerboard array design is illustrated schematically 10 in FIG. 2. The design uses a planar array of electrically conducting squares e.g. 11 forming a tiled-like pattern where the squares are equal in size and orientation and of approximately the same area as the inter-square region. The array design includes electrical circuits (not shown) that connect neighboring squares between pairs of nearest corners.

As illustrated in FIG. 3, the electrical circuits include feed conductors 30 that connect the corners of the squares e.g. 11 to electrical circuits located some distance away toward a groundplane 31 that is parallel to the plane of the squares 11. The conductors of the circuits may pass through holes 32 in the groundplane 31, and may include connections to the groundplane and may include one or more terminals to which other circuits may be connected. The circuits may include amplifiers that amplify signals to be received or transmitted to the array.

A circuit configuration that has been found to be effective is illustrated 40 in FIG. 4, with the square patch being interconnected to an amplifier 42 for output of differential voltages e.g. 43. FIG. 5 illustrates the same arrangement as FIG. 4, with the addition of an outside Balun 51 to provide a differential voltage output.

It is desirable to provide an improved form of tiled array design.

SUMMARY OF THE INVENTION

It is an object of the present invention to provide an effective form of transmitter and or receiver.

In accordance with an aspect of the present invention, there is provided an antenna device including: a first conductive extended body structure including a first surface; a series of spaced apart conductive patches arranged substantially in the plane of a second surface offset from said first surface; a series of conductive feed interconnections capacitively coupled to the spaced apart array of conductive patches, said conductive feed interconnections being profiled to provide a complementary series inductance to said capacitive coupling so as to thereby improve the impedance matching of the conductive feed and conductive patches.

Preferably, the antenna device operates over a predetermined frequency range and the reactance of the conductive feed and conductive patch interconnection is negative at low operational frequencies and positive at high operational frequencies and zero at an intermediate frequency.

Preferably, the first surface forms one side of a thin sheet. In some embodiments, the conductive feed interconnections are arranged into two sets of orthogonal polarizations for feeding corresponding conductive patches in a polarization orthogonal manner. In some embodiments, the conductive feed interconnections include an elongated portion substantially parallel to the surface of any adjacent conductive patches. Preferably, the feeds from orthogonal polarizations are spaced apart when coupled to the patches.

In some embodiments, the elongated portion includes a capacitive plate portion overlapping the conductive patch to provide controlled capacitive coupling thereto. The capacitive plate portion can comprise an end portion of the conductive feed. In accordance with a further aspect of the present invention, there is provided an antenna device including: a conductive ground sheet of a substantially planar form; and a series of spaced apart conductive patches arranged substantially in a plane parallel to the conductive ground plane; a series of conductive feed interconnections electromagnetically coupled to the spaced apart array of conductive patches. The conductive feed interconnections can include an elongated portion substantially parallel to the plane of the conductive patches. The elongated portion can be in the same plane as the plane of the conductive patches.

The conductive ground sheet preferably can include a series of apertures and the conductive feed interconnections are preferably fed through the apertures. The conductive feed interconnections are preferably surrounded by a shield adjacent the conductive ground sheet. The shield can be conductively interconnected to the ground sheet.

The conductive patches are preferably arranged in a regular array. In one embodiment, the conductive patches are preferably capacitively coupled to the conductive feed interconnections. In other embodiments, the conductive patches and the conductive feed interconnections are preferably separated by a small non conductive gap.

The conductive patches are preferably of a generally square form with rounded corners. In some embodiments, the conductive feeds from the closest electromagnetic coupling with the conductive patches at the corners of the conductive patches. The conductive feeds surround the conductive patches and are preferably generally of an elongated form with the elongation being in a direction radial to the center of a corresponding conductive patch.

In some embodiments, pairs of the feed conductors are preferably shielded by a conductive unit interconnected to the ground sheet in the area adjacent the ground sheet, the conductive unit of a generally boxed form having a slot in one surface thereof between the pairs. In accordance with a further aspect of the present invention, there is provided a method of designing an antenna array device, the device including a first conductive extended body structure including a first surface; a series of spaced apart conductive patches arranged substantially in a second surface offset from the first surface; a series of conductive feed interconnections electromagnetically coupled to the spaced apart array of conductive patches, the method including the step of: providing a conductive patch pattern that increases the conductive patch inductance in comparison with a checkerboard or self complementary array when said antenna array device is operated at frequencies greater than an equivalent wavelength less than the quarter wave distance between the first surface and the second surface.

Preferably, the method also includes increasing the conductive patch inductance through a reduction in size of the patches relative to a checkerboard or self complementary pattern.

Preferably, the conductive patch inductance is increased through the utilisation of a smaller conductive patch and a series of elongated conductive feed interconnections in said second surface.

Preferably, the method also includes increasing the capacitance of the antenna array device when operated at frequencies lower than an equivalent frequency to the wavelength greater than the quarter wave distance between the first surface and the second surface. The capacitance can be increased by the interconnection of a capacitive device between predetermined conductive patches and corresponding conductive feed interconnections.

In accordance with a further aspect of the present invention there is provided a method of suppressing the amount of common mode current in an antenna array device, said device including a first conductive body structure including a first surface; a series of spaced apart conductive patches arranged substantially in a plane of a second surface offset from the first surface; and a series of conductive feed interconnections electromagnetically coupled to the spaced apart array of conductive patches, the method including the step of: suppressing the common mode current by means of shielding the conductive feed interconnections in the vicinity of said first conductive body structure sheet.

Preferably, the shielding includes a conductive shield conductively interconnected to said first conductive body structure. In some embodiments, the conductive feed interconnections are driven in a voltage differential mode.

BRIEF DESCRIPTION OF THE DRAWINGS

Preferred embodiments of the invention will now be described, by way of example only, with reference to the accompanying drawings in which:

FIG. 14 illustrates the results of utilization of conductive tubes around feed conductors;

DETAILED DESCRIPTION

In the preferred embodiments there is provided a modified form of self complementary antenna tiled array design that leads to improved performance parameters.

Figure 1:
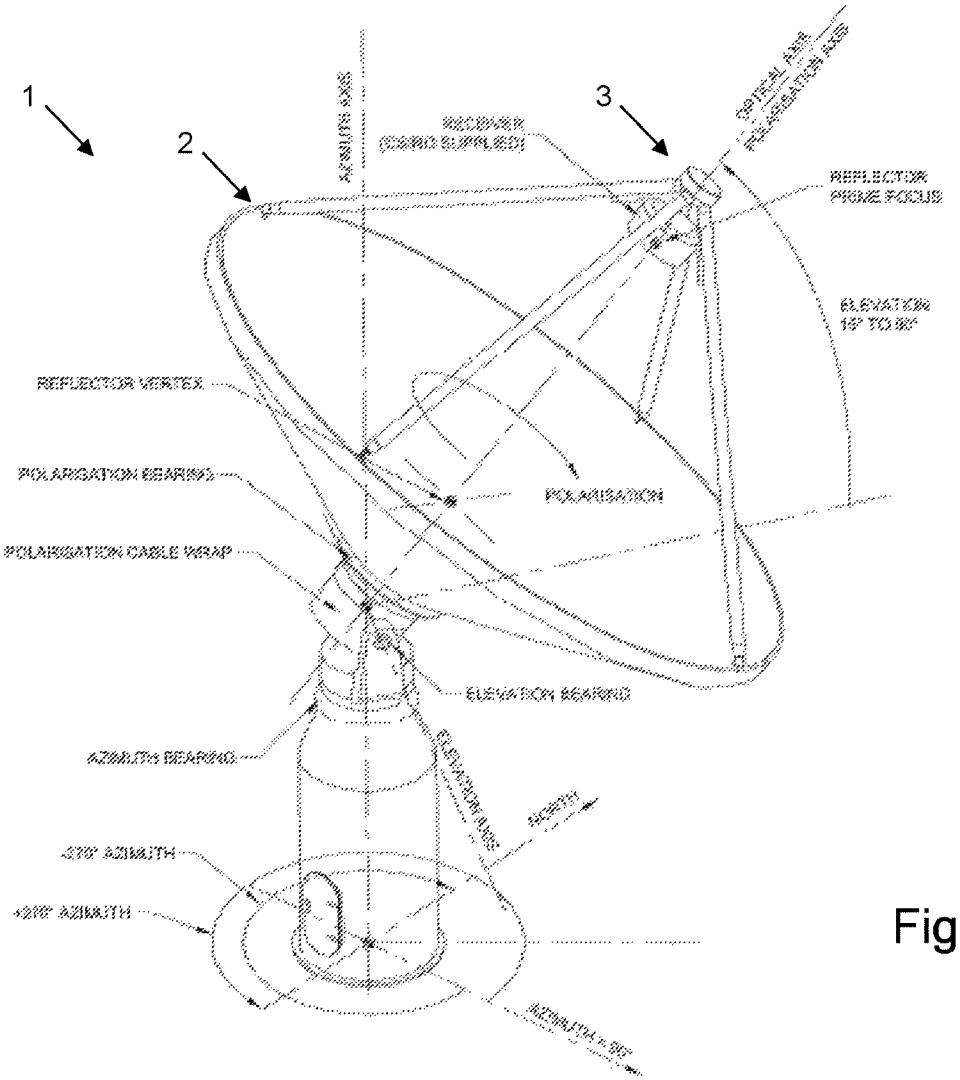
FIG. 1 illustrates a parabolic transmitter/receiver.
Figure 2:
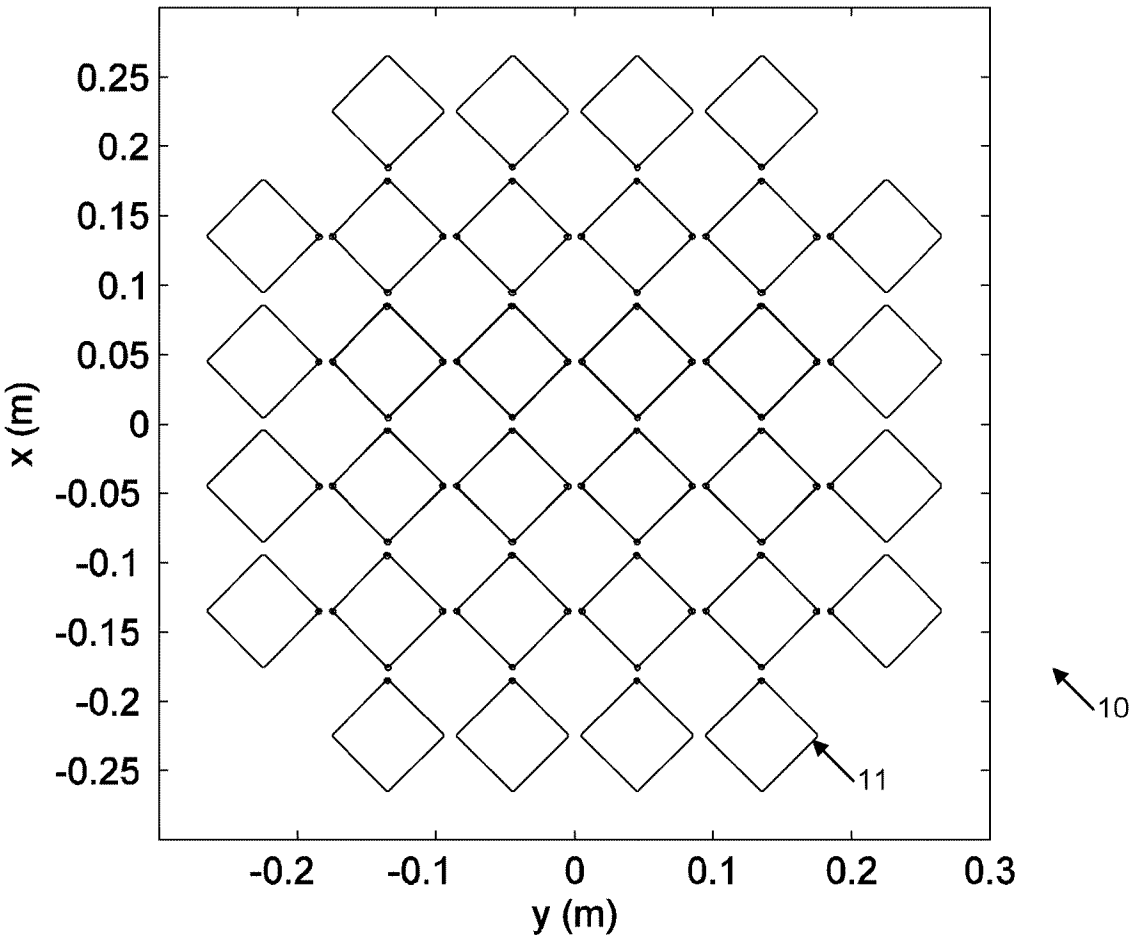
FIG. 2 illustrates a plan view of a checkerboard transmitter/receiver.
Figure 3:
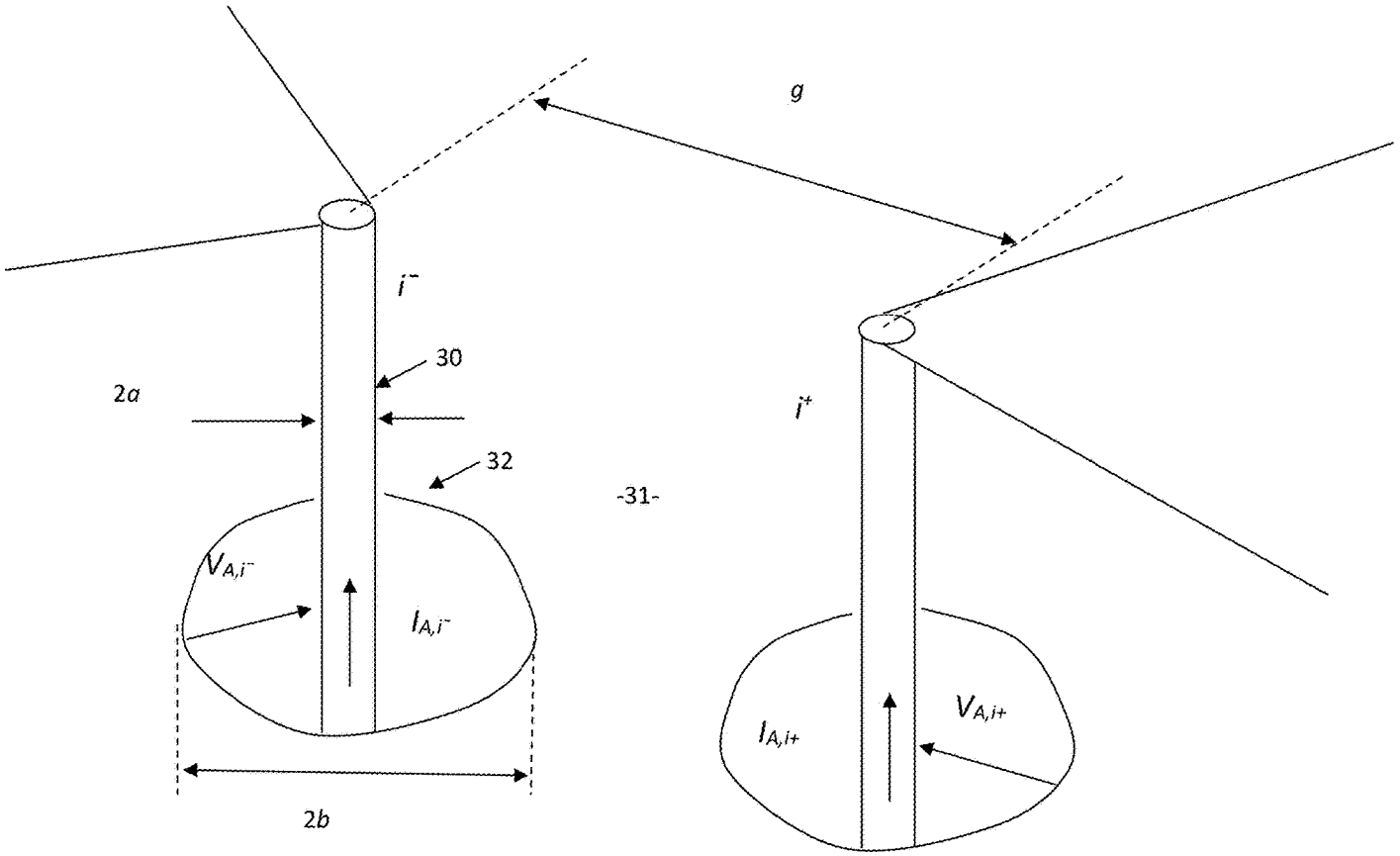
FIG. 3 illustrates schematically the interconnection of array patches to feed conductors through the ground plane of a checkerboard array.
Figure 6:
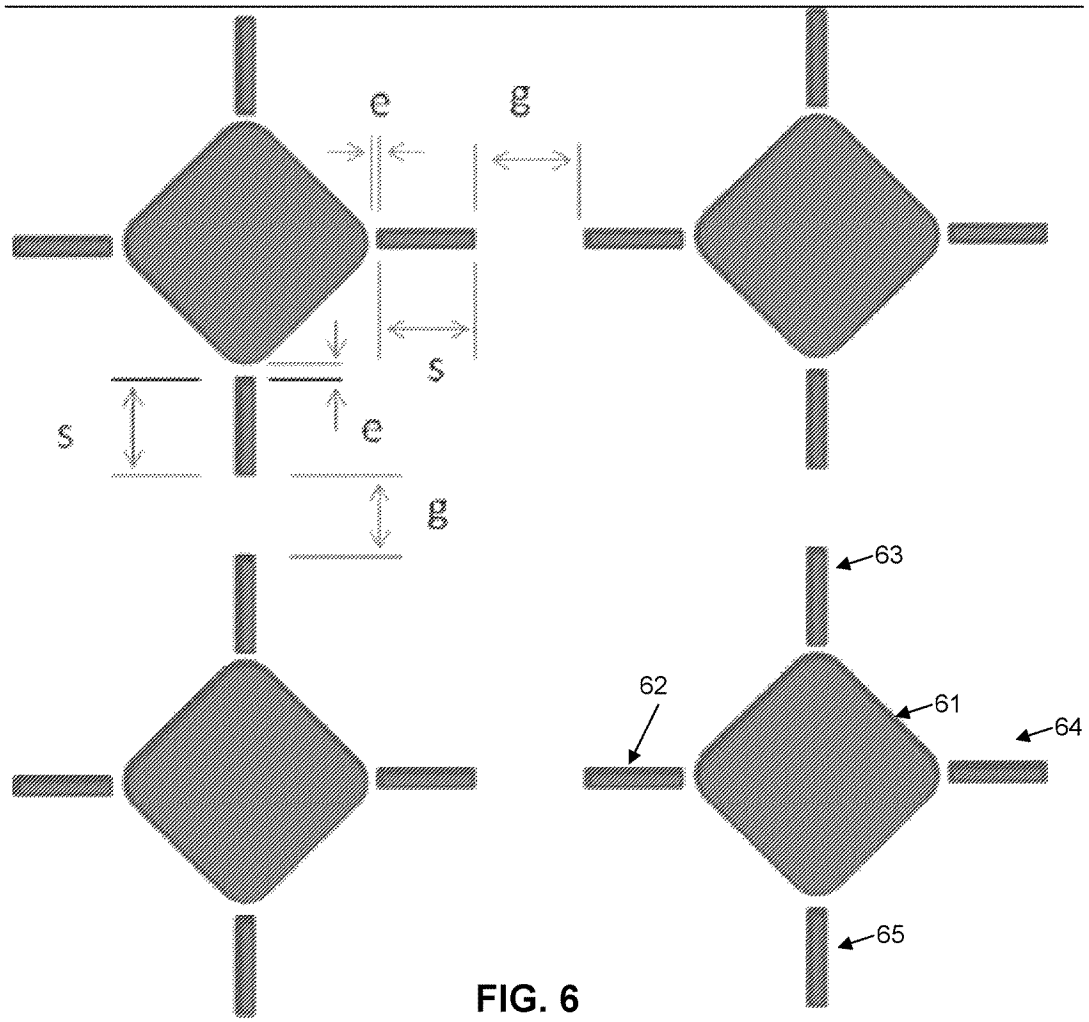
FIG. 6 illustrates a plan view of the modified geometry of the array of the preferred embodiment.
Figure 7:
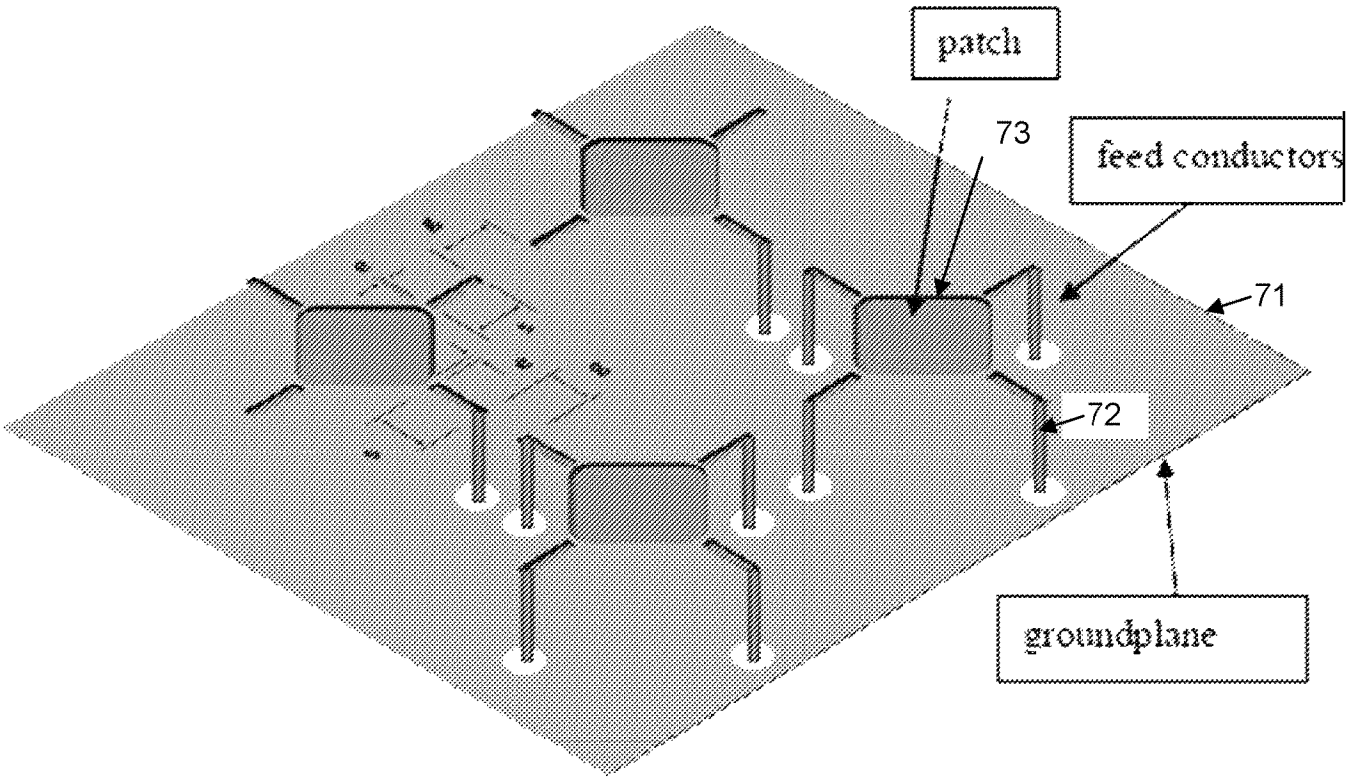
FIG. 7 illustrates a side perspective view of a portion of the array of FIG. 6, showing patches, feed conductors and ground plane.

As illustrated initially in FIG. 6 in a plan view, the purely tiled design of FIG. 2 is modified, with the tiles being replaced with a 'star' arrangement, including a central portion 61 and a series of outer bar portions 62-65 which are separated from the central portion my means of a small gap. The central portion 61 is substantially square with rounded edges. FIG. 7 illustrates a side view of the patches 73, with feed conductors 72 projecting through ground plane 71.

Figure 8:
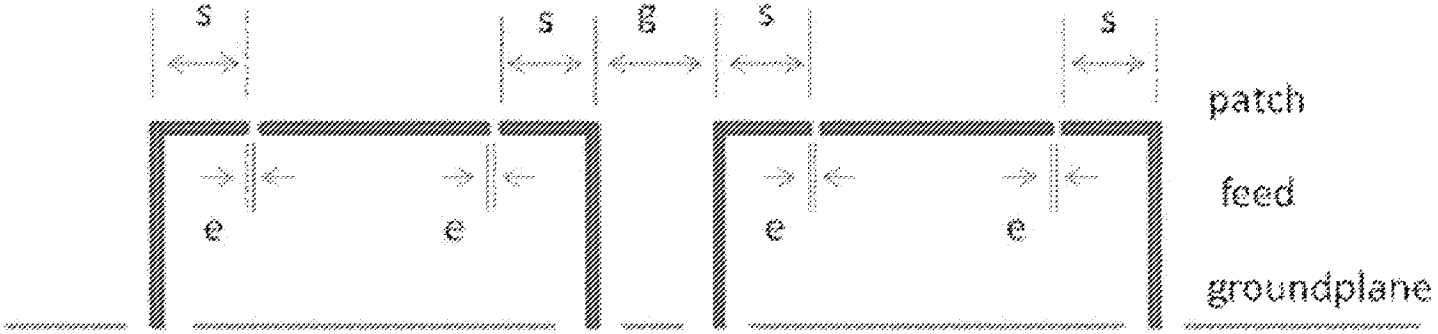
FIG. 8 is a first side sectional view of one form of arrangement of feed conductors and patches.
Figure 9:
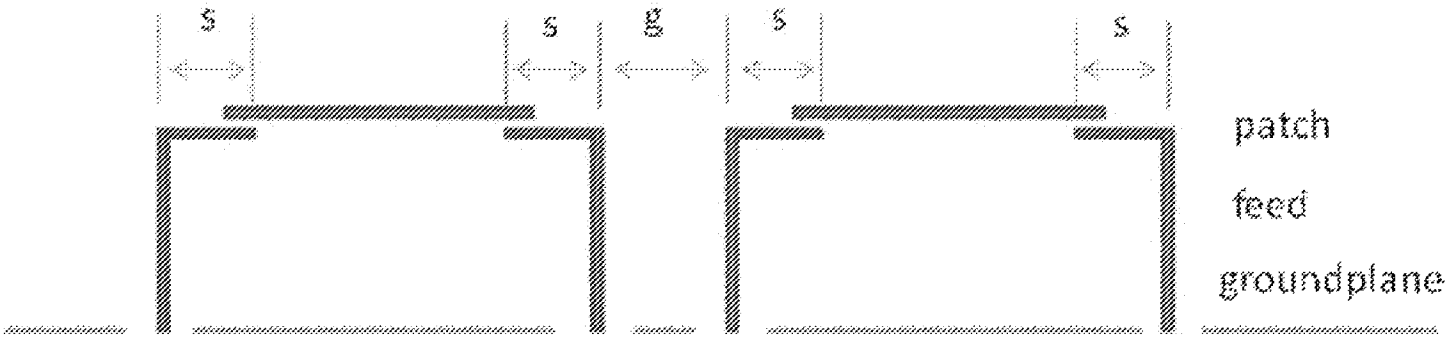
FIG. 9 is a second side sectional view of an alternative arrangement of feed conductors and patches.

As shown in FIG. 8, the patch components can be separated from the feed conductors by a small gap but remain co-planar therewith. Alternatively, as shown in FIG. 9, the patch can be offset from the feed conductors which are displaced in a parallel plane. In this latter case, the conducting parts may be overlapping in projection onto a common parallel plane.

Figure 10:
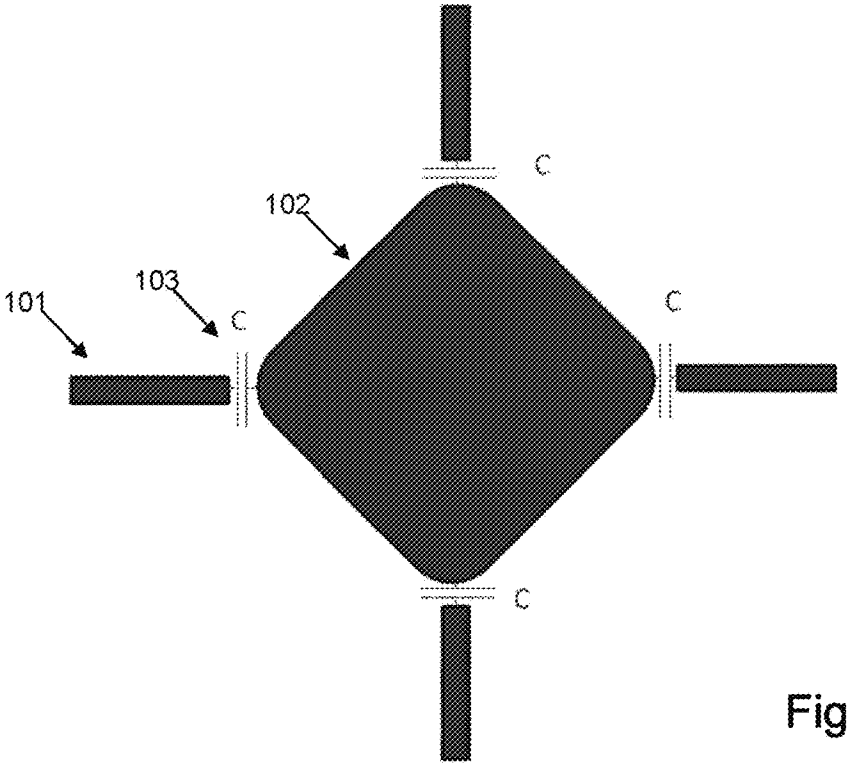
FIG. 10 illustrates a plan view showing capacitors interconnected across the patch, feed conductor interface.

As shown in FIG. 10, the edges between feed conductors 101 and patch 102 may be connected by electrical circuits such as capacitors.

The modifications to the tiled array design can be used to change the impedance of the array in a way that improves the impedance matching of the array and the electrical circuits connecting the array elements. Improving the impedance match between the array and the circuits can increase the array performance in terms of received or transmitted signal power transfer between the array and the circuits or the noise contribution from low-noise amplifiers in these circuits when the array is operated in reception. The improvement in impedance matching may be achieved over a range of frequencies increasing the useful bandwidth of the array.

Figure 11:
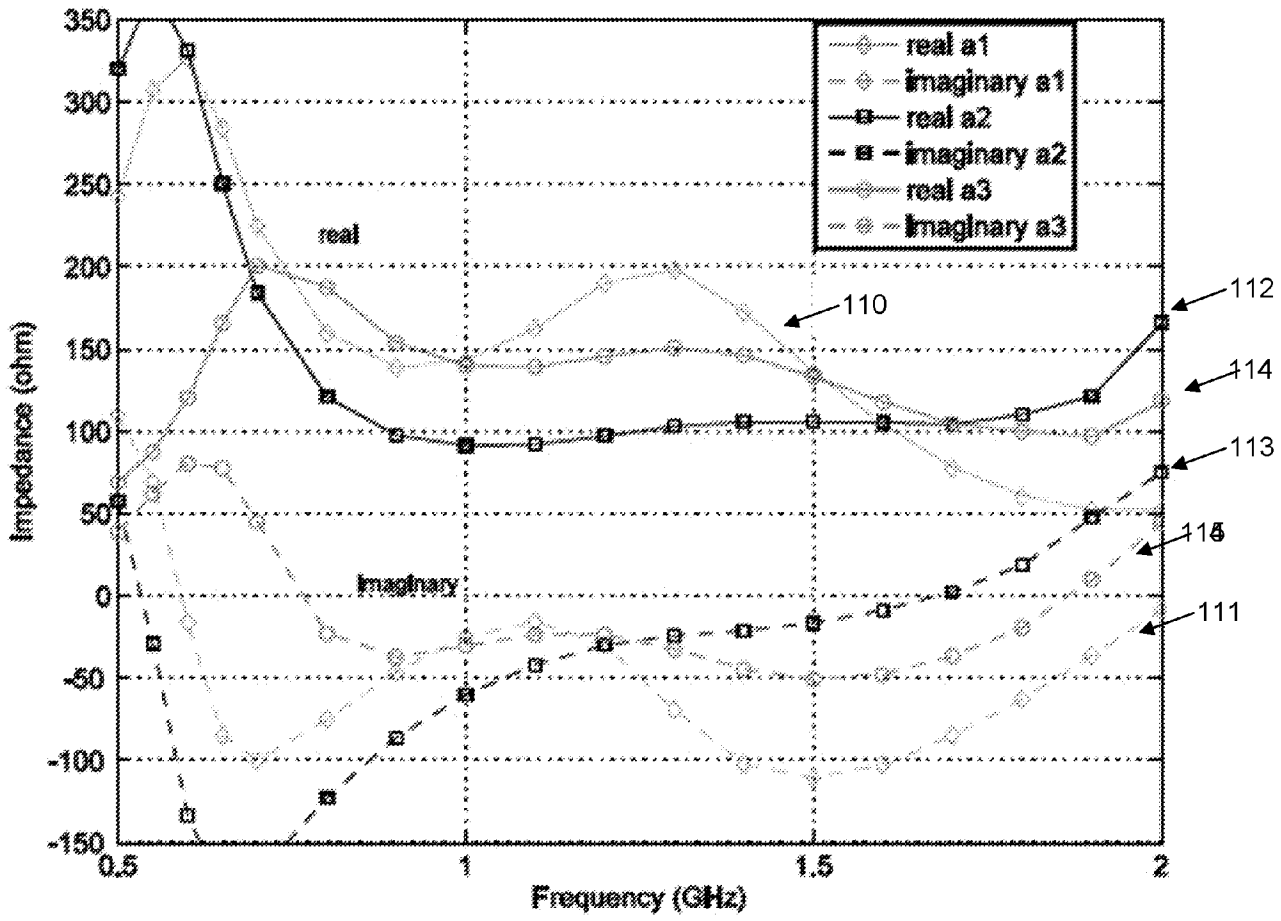
FIG. 11 illustrates simulated array impedances for various tiled designs.
Figure 12:
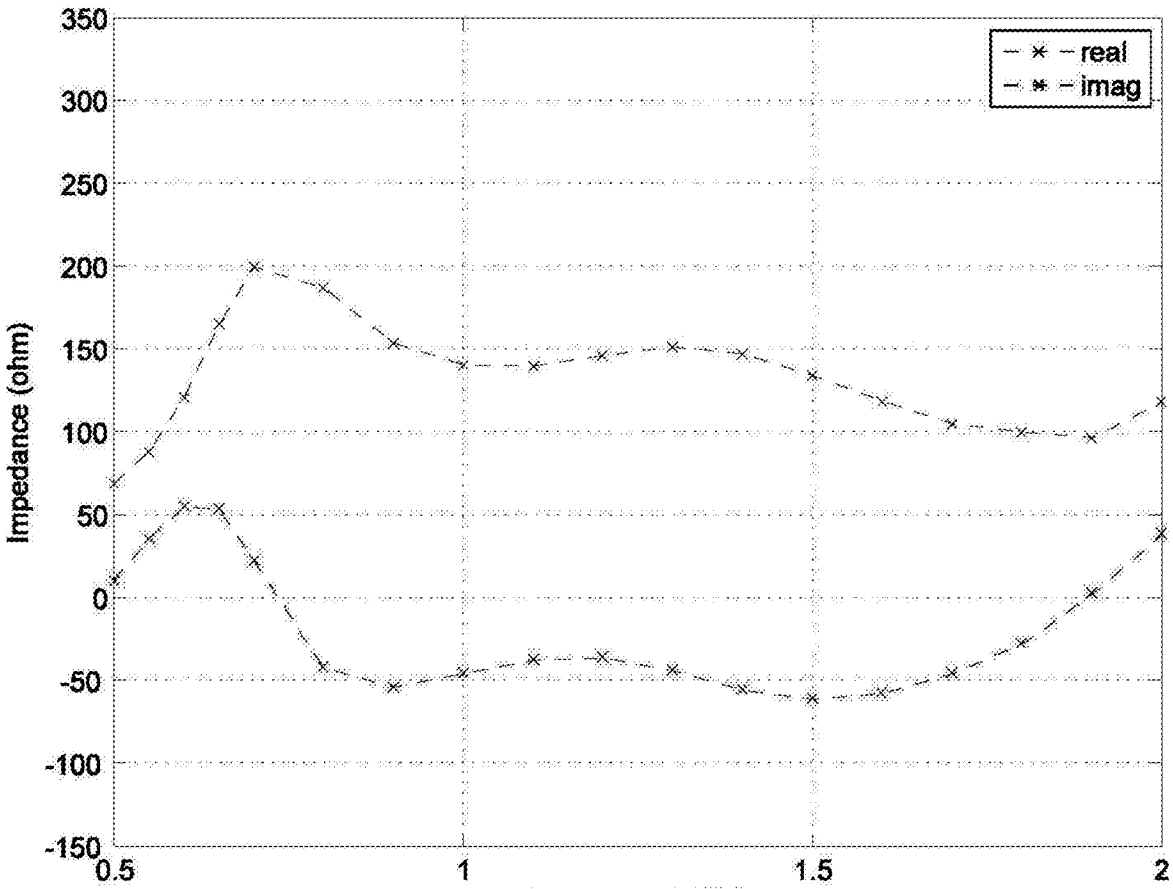
FIG. 12 illustrates the array impedance with capacitors between the feed conductors and patches.

FIG. 11 shows modeling results that illustrate the possible changes to the array impedance.

The initial curves 110 and 111 represent the original checkerboard array of the aforementioned specification. The real and imaginary parts of the impedance vary with frequency in a way that may limit impedance matching to practical circuits connecting the array elements.

The second series of curves 112, 113 are the real and imaginary impedance components for the modified array with reduced patch size but no gaps. It is evident that the modification to the patch geometry has resulted in a substantial change in the array impedance at high frequency. These changes include increase in the real part and decrease the magnitude of the imaginary part of the impedance, and a decrease in the variation of the impedance with frequency at high frequencies.

The third series of curves 114, 115 curves show the results for the modified array with the addition of the gaps and insertion of a 2 pF circuit capacitor between the gaps. As illustrated, the capacitive gaps can be used to change the array impedance at low frequency. It can be seen that the two modifications can be used together to change the array impedance at low and high frequency giving a closer approximation to a constant real impedance over an increased frequency range.

Further improvement of the impedance matching may be obtained by coupling the patch array to the driving circuits via series capacitors at the array terminals at the groundplane. FIG. 9 illustrates impedance of the modified array (s=13 mm, gap capacitance C=2 pF) in series with 10 pF capacitance at the array terminals. This impedance is the single-ended active impedance between the array feed conductors and the groundplane and is approximately equal to 150 ohms over a frequency range of more than 3:1.

Figure 13:
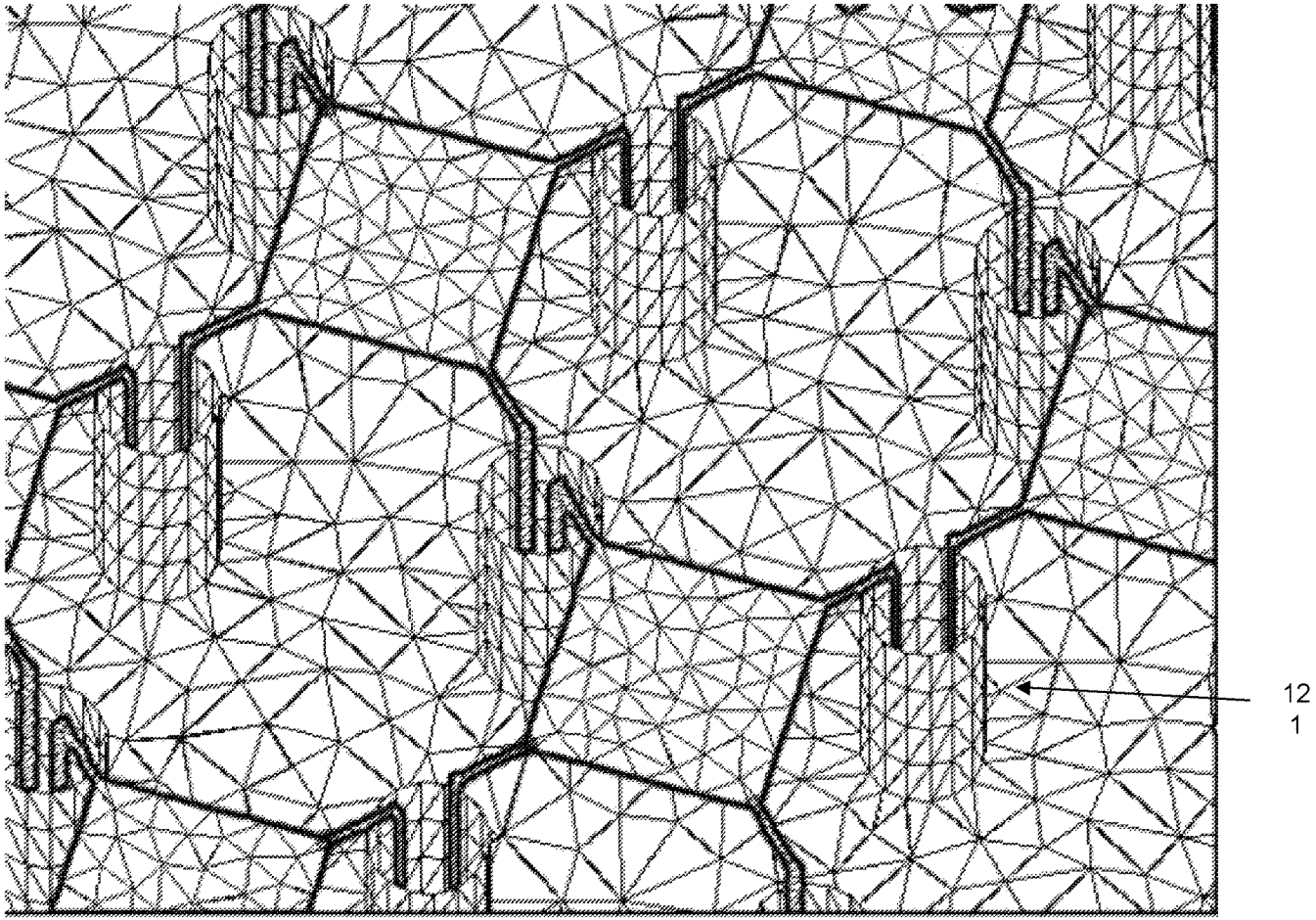
FIG. 13 illustrates the utilization of conductive tubes around the feed conductors.

An optional further modification to the array is illustrated in the FEM plot of FIG. 13. Here a conducting tube 121 connected to the groundplane partly surrounds the two feed conductors and provides shielding for the connecting nearest-pair patch corners. This modification may be used to increase the signal strength and signal-to-noise ratio particularly when the connecting circuit configuration shown in FIG. 6 is used and the individual differential voltage outputs v1-v2 of these circuits are linearly combined in a beamformer. This configuration is referred to as differential-single-ended (DSE) beamforming and the increase in signal and signal-to-noise ratio occurs in the beamformed signal. Modeling results illustrating the increase in signal strength can be seen by comparing the signal power transfer efficiencies shown in FIGS. 14 and 15. The shielding acts to suppress the common mode current or enhances the differential mode current of the conductive surrounded feed interconnections.

Figure 15:
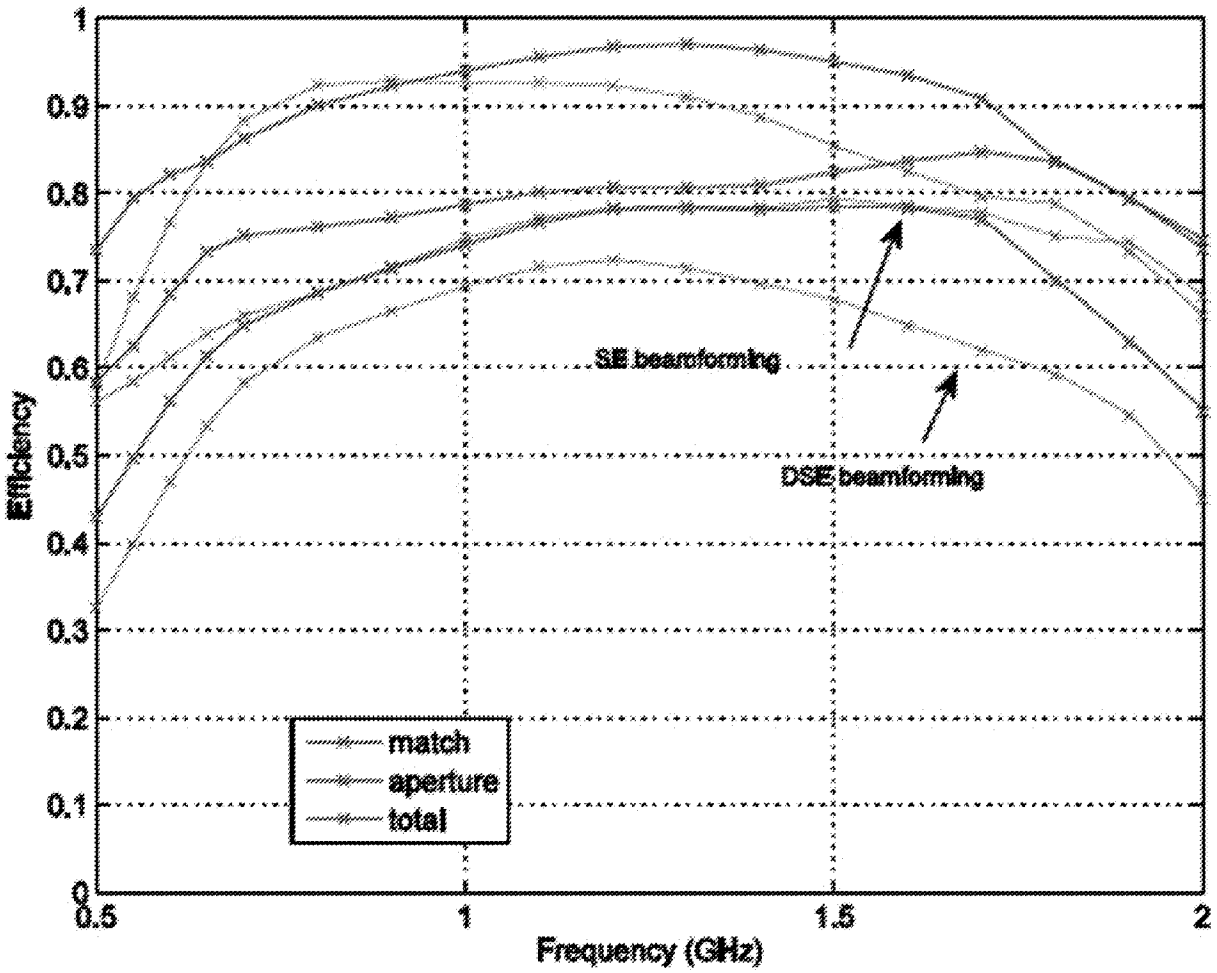
FIG. 15 illustrates similar results to FIG. 14, however, the conductive tubes have been removed.

FIG. 14 illustrates the efficiencies of 5×4 tiled array with conducting tubes around feed conductors (s=13 mm, t=50 mm, added gap capacitance C=1.2 pF and array ports terminated in single-ended impedance of z0=100 ohm). Results are shown for single-ended (SE) and differential-single-ended (DSE) beamforming of the array signals when illuminated by the focal-region field of a paraboloidal reflector with focal-length-to-diameter ratio of 0.5. FIG. 15 illustrates similar results for a 5×4 array without inclusion of conducting tubes around the feed conductors. It can be seen that the addition of the tubes increases the DSE beamformed signal power, particularly at high frequency.

Figure 16:
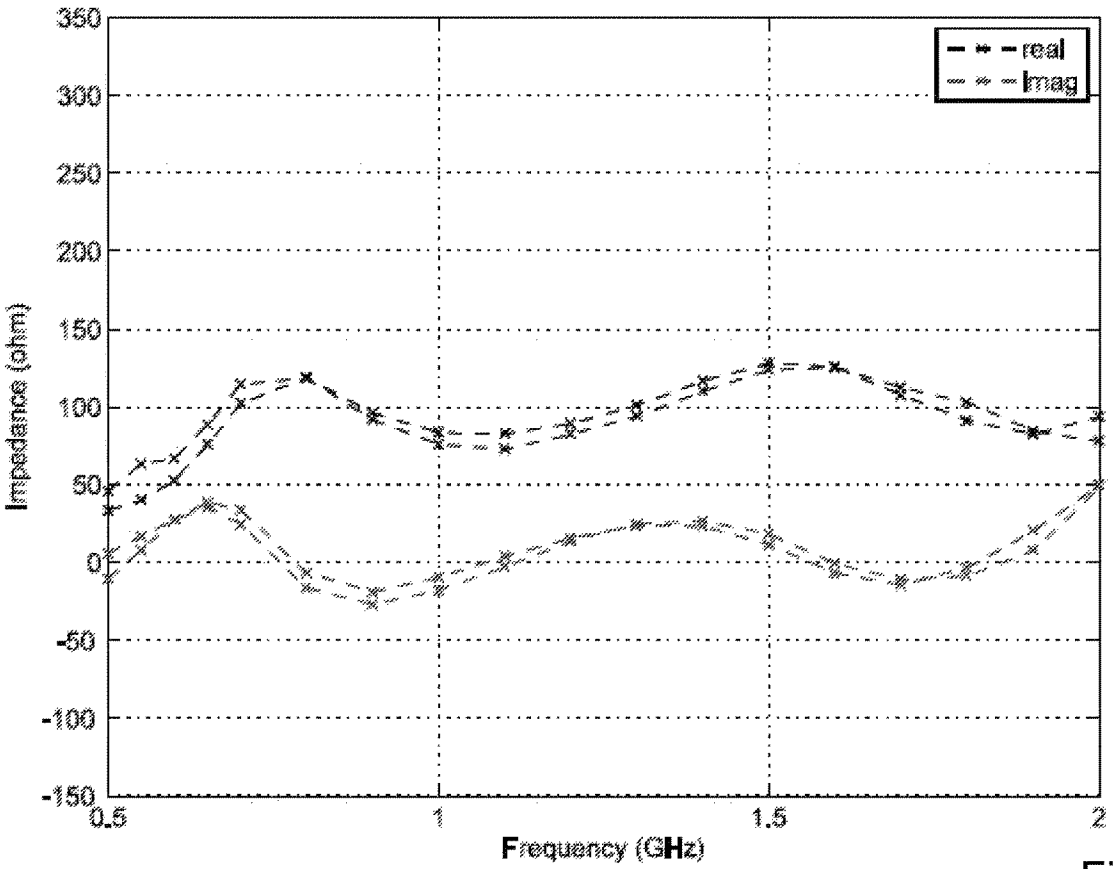
FIG. 16 illustrates the impedance of a 5×4 array with tubes around the feed conductors.

A second use of this modification may be to change the array impedance. FIG. 16 illustrates a general decrease in the magnitude of array impedance giving a single-ended impedance of approximately 100 ohm over a frequency range of more than 3:1 when shielding tubes are used.

Figure 17:
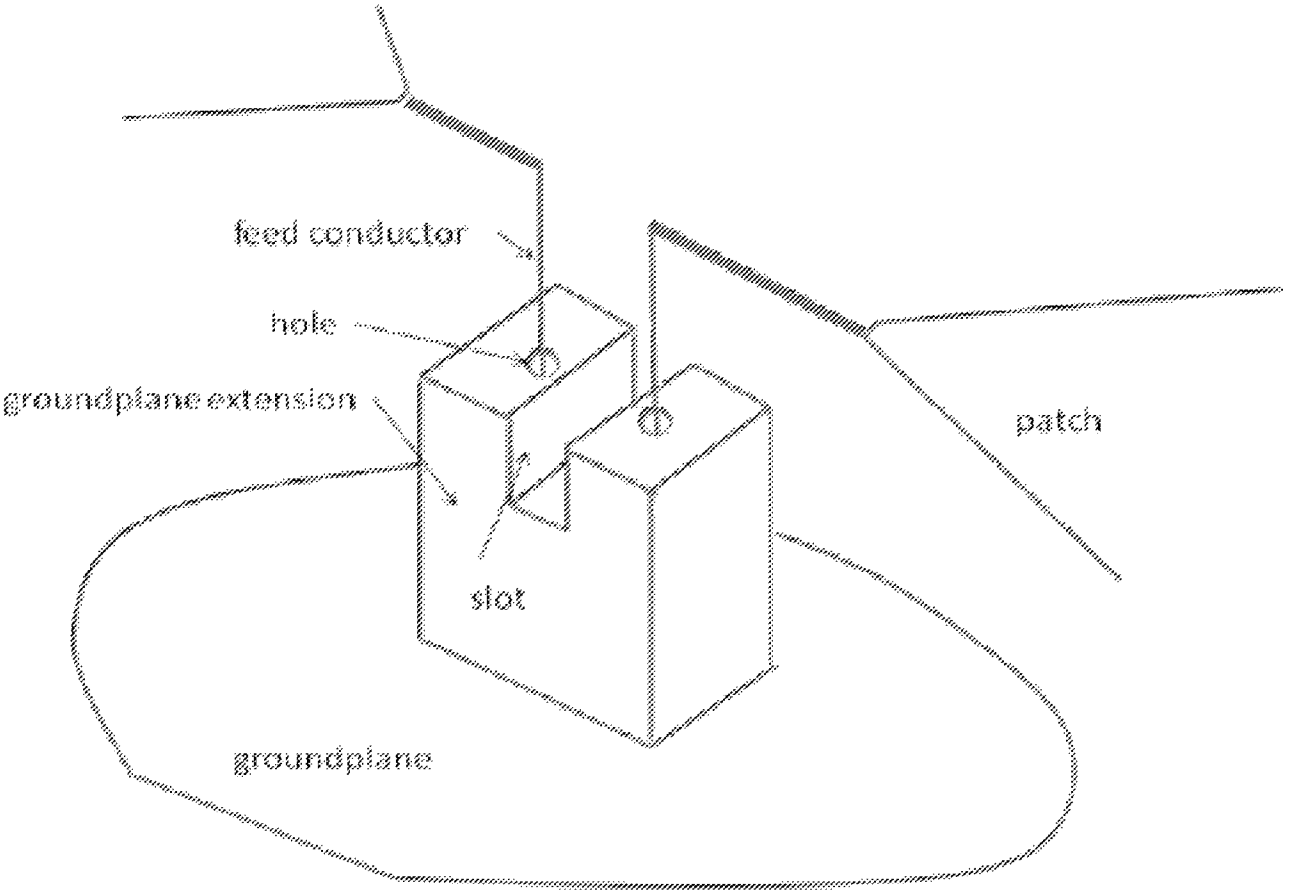
FIG. 17 illustrates a further modification of surrounding the feed conductors with a slotted groundplane extension.

Another optional modification to the array is illustrated in FIG. 17. In some implementations it may be useful to extend, in the direction of the plane of the patch array, the conducting surface of the groundplane containing the holes through which the array feed conductors pass. In this case the conducting surface connected to the groundplane may include a slot in the region between the feed conductors. This slot may be used to change the array impedance, adding series inductance at high frequency, giving greater flexibility in impedance matching the array to practical connecting circuits.

Figure 5:
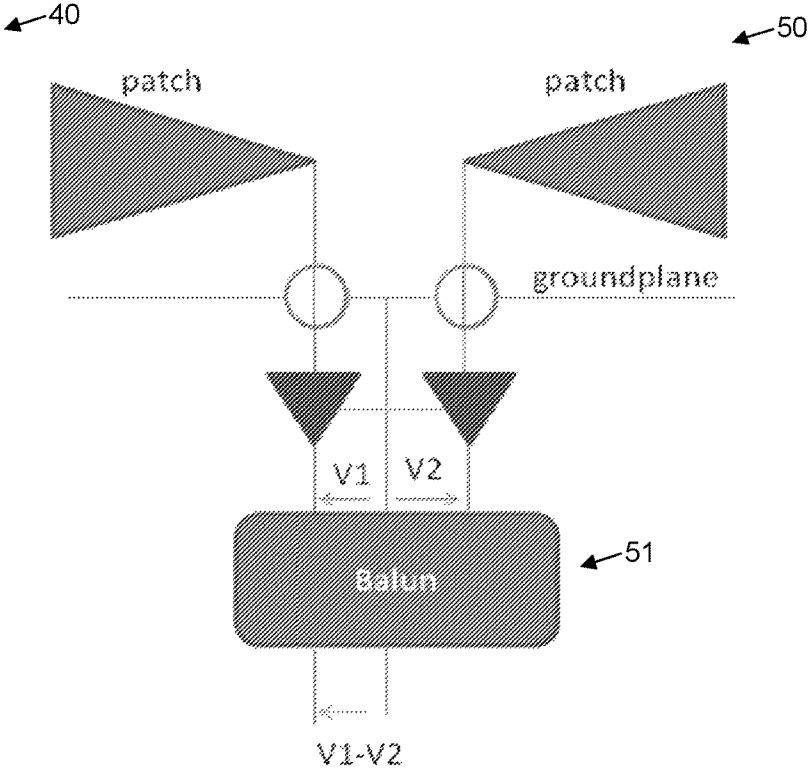
FIG. 5 illustrates schematically a similar arrangement to FIG. 4 with an output side Balun.
Figure 4:
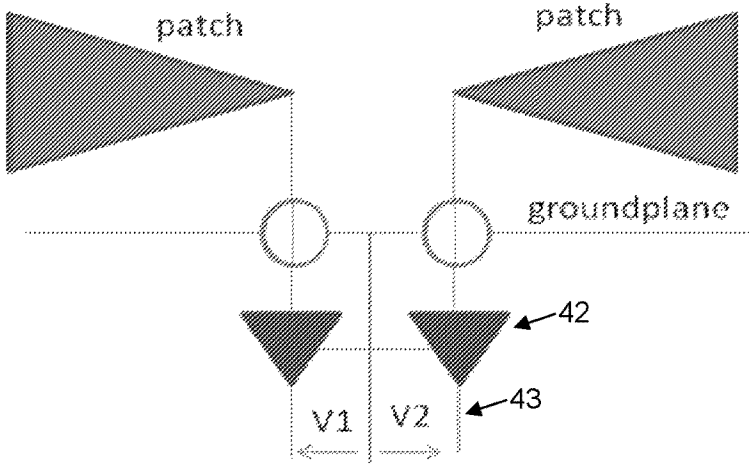
FIG. 4 illustrates schematically the electrical interconnection of dual single-ended amplifiers to the array patch elements.
Figure 18:
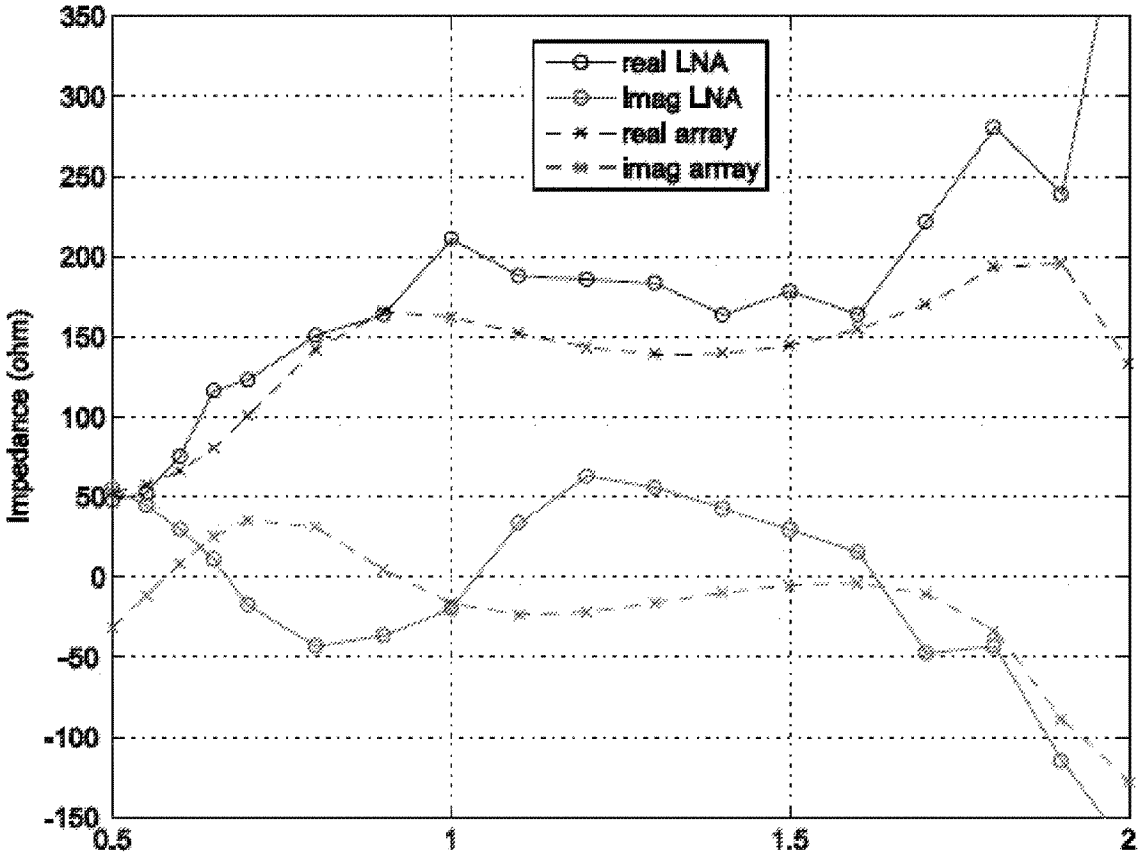
FIG. 18 illustrates a graph of the array and low noise amplifiers minimum noise impedances.
Figure 19:
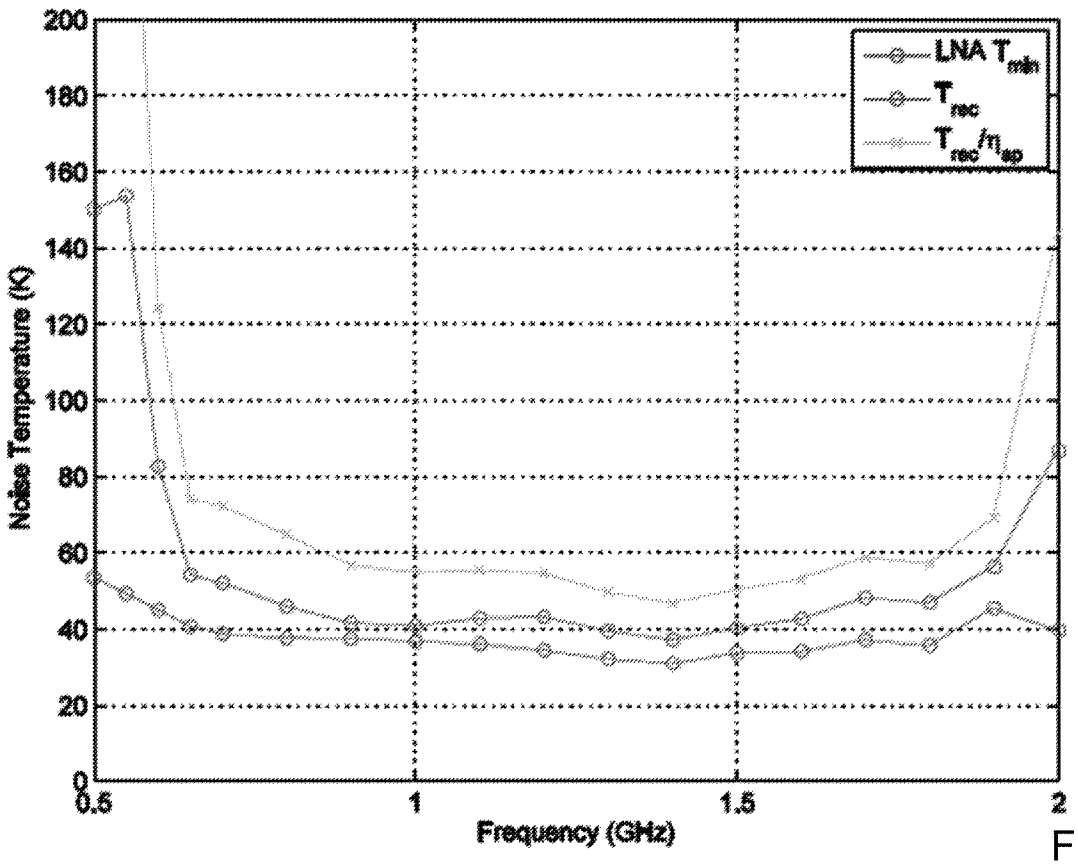
FIG. 19 illustrates a graph of noise temperatures for a revised tiled array.

The flexibility and performance that may be obtained using combinations of such modifications to the array is illustrated in FIG. 18 and FIG. 19. FIG. 18 shows calculated impedance matching of a 5×4 array to a practical low-noise amplifier (LNA) circuit. The LNA is of the form shown in FIG. 5. The multiport LNA noise and signal impedances have been estimated from measurements on individual LNA circuits. FIG. 19 shows the minimum noise temperature of the LNA. FIG. 19 also shows the noise and signal-to-noise ratio parameters of the combined array and LNA system. These parameters are the receiver noise temperature (Trec) and the signal-to-noise ratio parameter (Trec/aperture efficiency) associated with the DSE beamformed signal of the array. Greater signal-to-noise ratios can be expected with a larger array.

The design of the embodiments therefore provides an increased frequency range with good impedance match of the array and the electrical circuits connecting the array elements. When receiving, good impedance matching implies high sensitivity or signal-to-noise ratio, particularly when the noise is dominated by the contribution from low-noise amplifiers in the connecting circuits. An associated advantage particularly for low-noise receiving applications is that the introduced circuit matching elements can all be low-loss capacitors. Inductor circuit elements, which typically have relatively high loss, are not required. In the improved array design, inductive effects are realized with low-loss modifications to the conducting surfaces of the array.

Another advantage of the preferred embodiments is increased efficiency when DSE beamforming of the array signals is applied. This also implies decreased equivalent system noise temperature in receiving applications since the definition of equivalent noise temperature includes power transfer efficiency. The increased power transfer into the differential mode implies decreased power in the associated common-mode component that is not beamformed in the DSE configuration. The DSE configuration is very important in many applications. Compared to the full SE beamforming, the DSE configuration halves the cost of signal digitization and digital beamforming.

The modified tiled arrangement described has particular application in the fields of Astronomy, Communications, Health and Security.

First Embodiment Analysis

Figure 20:
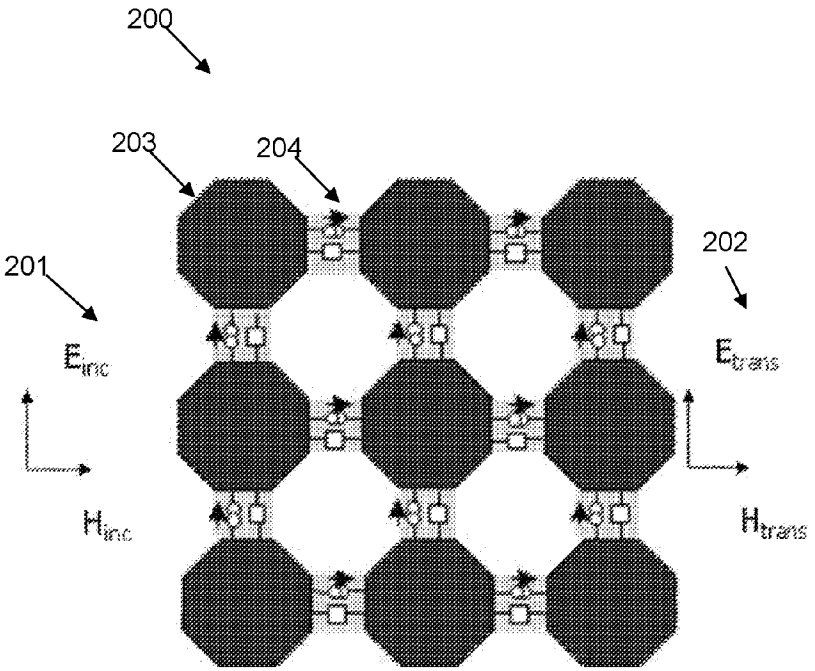
FIG. 20 illustrates schematically a self complementary array structure.

Whilst not wishing to be bound by theory, the first embodiment is considered to have a number of advantageous impedance characteristics. These can be highlighted by examination of an approximate equivalent circuit representation of the enhanced tiled array FIG. 20 illustrates a number of contiguous elements of a planar self-complementary array antenna 200 and the electric (E) and magnetic (H) field vectors of incident 201 and transmitted 202 plane waves propagating in a direction normal to the plane of the array. The array is modeled as a distribution of surface impedance Z(x,y) (ohms per square) as a function of Cartesian coordinates (x,y) of points in the plane of the array.

The distribution of surface impedance consists of perfect conductor e.g. 203, free space and feed region (204), the respective surface impedances being zero, infinite and $Z_0/2$ ohms per square, where $Z_0$=376.7 ohms is the wave impedance of free space.

Figure 21:
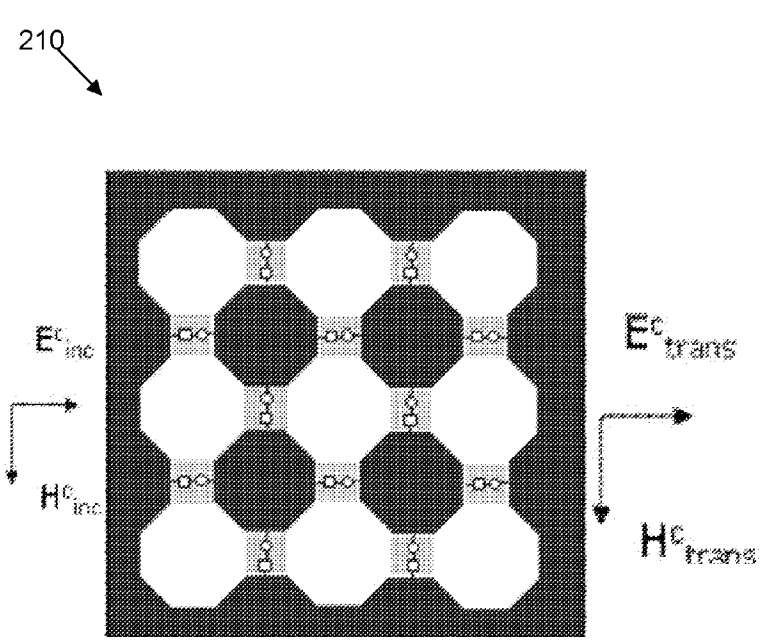
FIG. 21 illustrates the complementary form of the array of FIG. 20.

The self-complementary property of the array can be seen by examining the complementary array and field configuration illustrated 210 in FIG. 21. The complementary array is defined by the surface impedance $Z_c(x,y)$ such that the product $Z(x,y)\ Z_c(x,y)$ is equal to $(Z_0/2)$ squared, and the complementary field is defined as the original field but with the field vectors rotated around the direction of propagation by 90 degrees. The original array 200 in FIG. 20 is self-complementary because it maps onto its complement when rotated by 90 degrees around the centre of any of the grey feed regions. For any such array the feed region impedance is $Z_0/2$ ohms per square. A good discussion of this electromagnetic form of Babinet's Principle is given by Senior and Volakis (IEE Electromagnetic Waves Series, 41, 1995).

Figure 22:
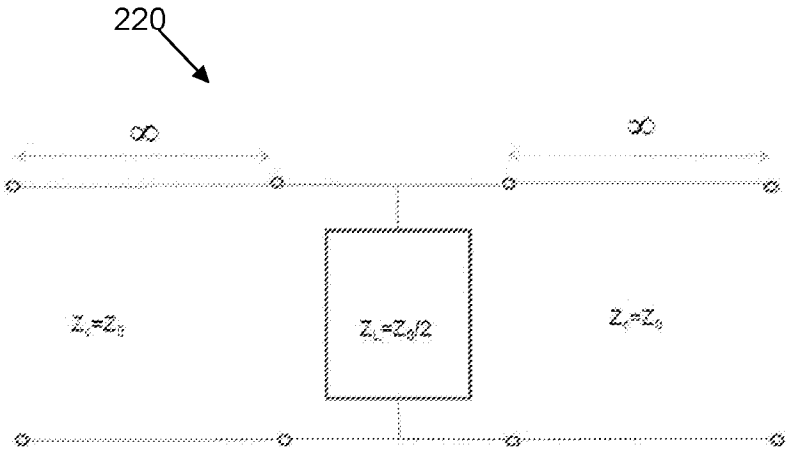
FIG. 22 illustrates the equivalent circuit of the self-complementary array.

FIG. 22 illustrates an equivalent circuit representation 220 of the self-complementary array. This consists of a lumped-element impedance of $Z_0/2$ representing the feed region surface impedances and two transmission lines of characteristic impedance $Z_0$ representing plane-wave propagation on either side of the plane of the array. This representation implies that the array should efficiently transmit or receive energy to or from such waves when the array conductors are connected to small electrical circuits occupying the feed regions and having an internal load impedance $Z_L$ of $Z_0/2$ ohms. Such circuits are also illustrated in FIG. 20 and FIG. 21.

Figure 23:
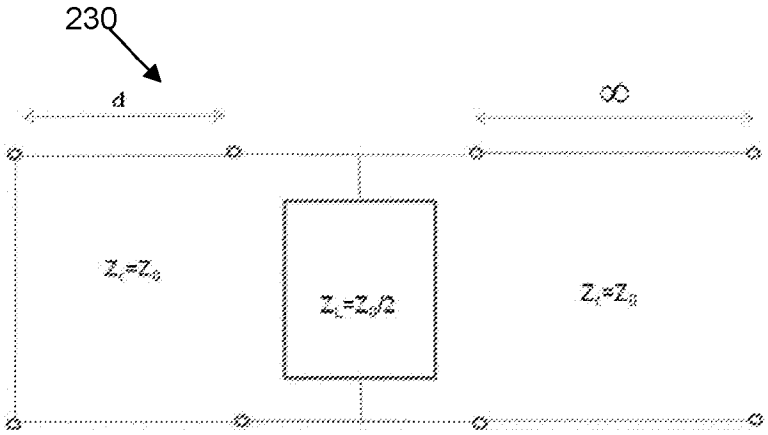
FIG. 23 illustrates an approximate equivalent circuit of a self complementary array and groundplane.

FIG. 23 illustrates an approximate equivalent circuit 230 of the self-complementary array when placed a distance d from a conducting plane (groundplane) parallel to the array. This is similar to the circuit of FIG. 22, but has the transmission line representing the field on the groundplane-side of the array being of finite length d and terminated by a short circuit.

Figure 24:
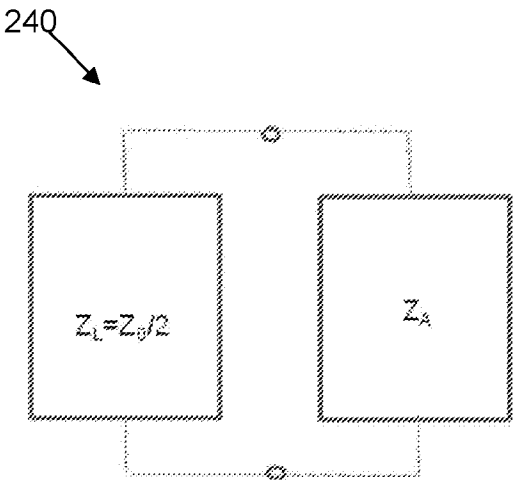
FIG. 24 illustrates schematically an approximate equivalent circuit consisting of load impedance and antenna impedance.

The total impedance connected to the load impedance in FIG. 23 is the parallel combination of the two impedances presented by the transmission lines. The can be denoted the antenna impedance and by solving the circuit of FIG. 24 this can be given by:

$$Z_A=(Z_0/2)\times(1-\exp(-j2kd))$$

where $k=2\pi/\lambda$ is the propagation constant of plane waves in free space and $\lambda$ is the corresponding wavelength. The definition of the impedance $Z_A$ allows the circuit of FIG. 23 to be simplified to the circuit 240 as shown in FIG. 24.

Figure 25:
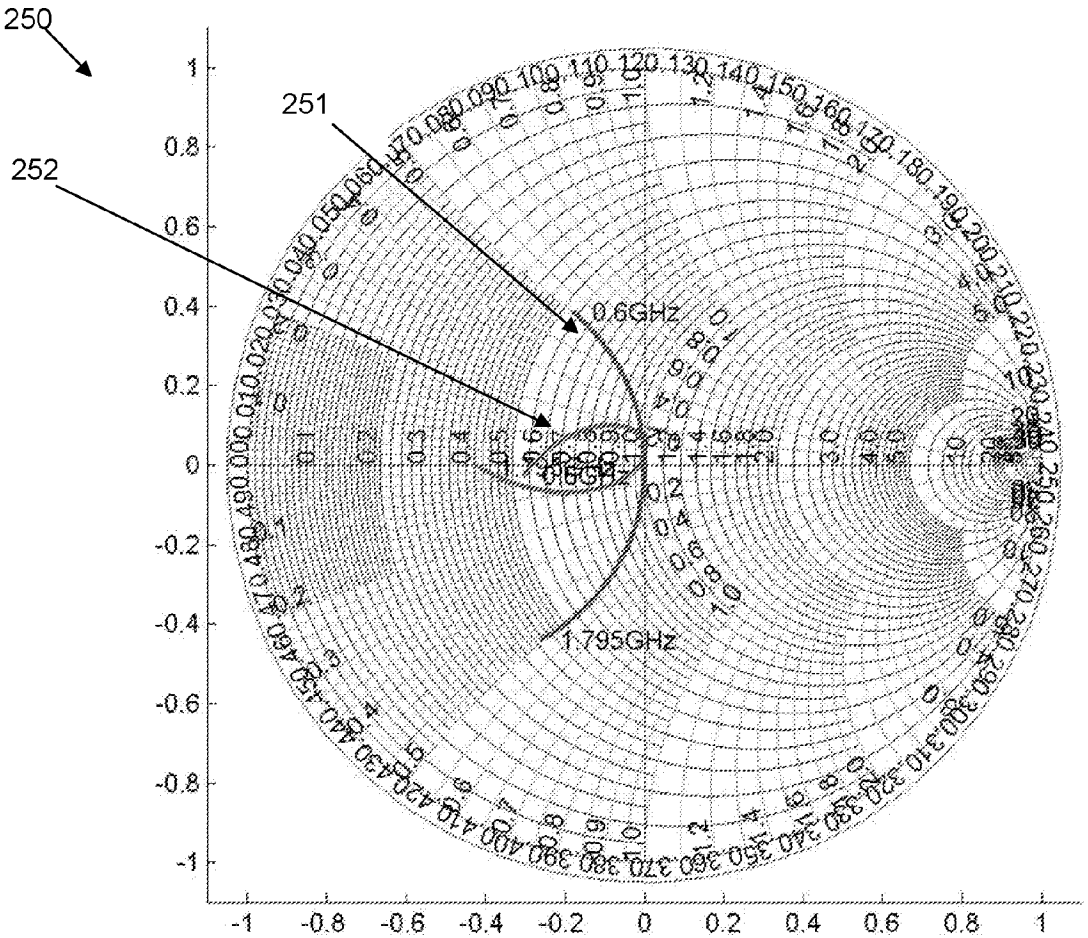
FIG. 25 illustrates an antenna impedance $Z_A$ plotted on a Smith chart where the reference impedance at the centre of the chart is $Z_0$. Also shown in the modified antenna impedance $Z_{AA}$ obtained by the series combination of $Z_A$ and the capacitance C1=0.9 pF and inductance L1=25 nH.

FIG. 25 illustrates the antenna impedance $Z_A$ plotted 251 as a function of frequency on a Smith chart 250 where the reference impedance at the centre of the chart is $Z_0$. The antenna impedance is equal to $Z_0$ at a frequency $f_0$ where the distance d between the groundplane and the self-complementary array is equal to $\lambda/4$. The introduction of the groundplane causes the antenna impedance $Z_A$ to vary with frequency and to be different from the load impedance $Z_L$. This impedance mismatch reduces the efficiency of power transfer from say an incident wave to the connected electrical load circuits. As shown in FIG. 25, at frequencies lower than $f_0$ the antenna impedance has an inductive reactance and at frequencies greater than $f_0$ the reactance of the antenna impedance is capacitive.

Figure 26:
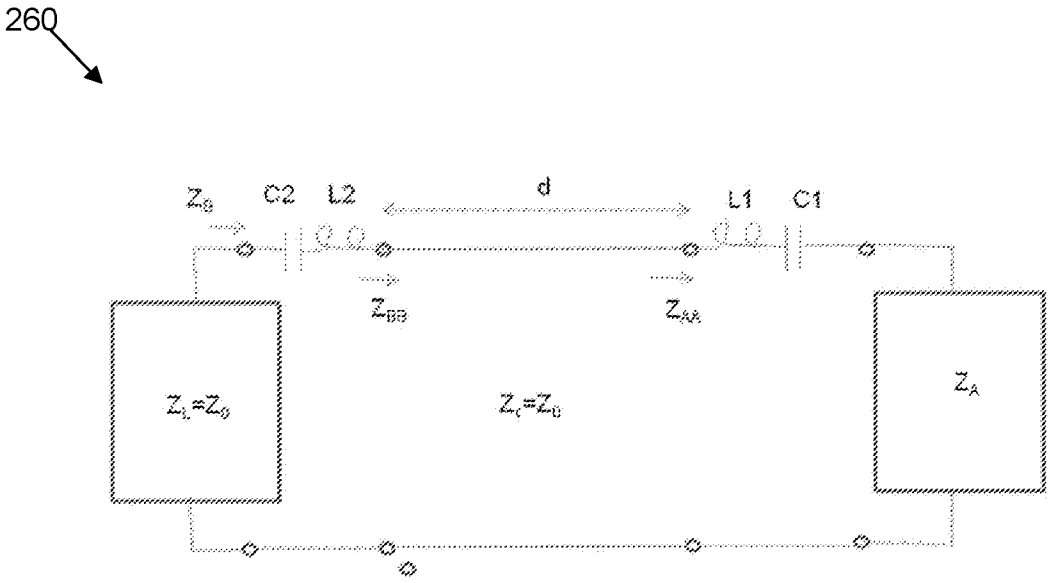
FIG. 26 illustrates an equivalent circuit for an array antenna with feed conductor transmission lines of length d and series capacitive and inductive circuit elements inserted between the self complementary array and the load circuits.

As shown in FIG. 26, the antenna impedance can be transformed so as to reduce the magnitude of the reactive component by adding a series capacitance C1 and a series inductance L1 to the antenna impedance. This combination of added series impedances adds capacitive and inductance reactance to the antenna impedance at frequencies below and above $f_0$ respectively. This thereby improves the impedance matching to the load circuit. The modified impedance is shown 252 obtained by the series combination of $Z_A$ and the capacitance C1=0.9 pF and inductance L1=25 nH.

Figure 27:
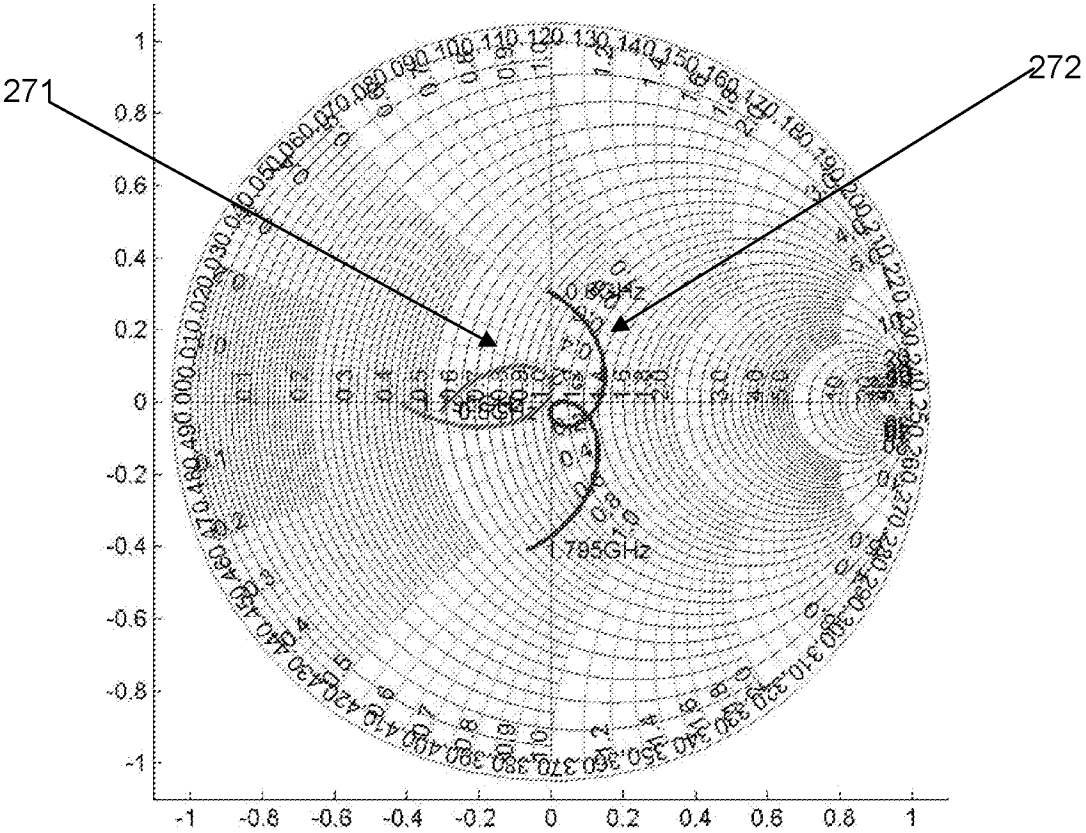
FIG. 27 illustrates the modified antenna impedance $Z_{AA}$ plotted on a Smith chart where the reference impedance at the centre of the chart is $Z_0$. Also shown is the impedance $Z_{BB}$ obtained by the series combination of $Z_{AA}$ and the feed conductor transmission lines of length d and characteristic impedance $Z_0$.

FIG. 26 illustrates the equivalent circuit of array antenna with feed conductor transmission lines of length d and series capacitive and inductive circuit elements inserted between the self complementary array and the load circuits. The load circuits are now at the groundplane and the impedance $Z_L$ of the load circuits is increased from $Z_0/2$ to $Z_0$. As illustrated in FIG. 27, the feed conductors that divert the array signals to load circuits removed to the groundplane of the array can also be represented in the equivalent circuit by a transmission of length d. As shown in FIG. 27, the addition of this transmission line transforms the effective antenna impedance from $Z_{AA}$ 271 to $Z_{BB}$ 272.

Figure 28:
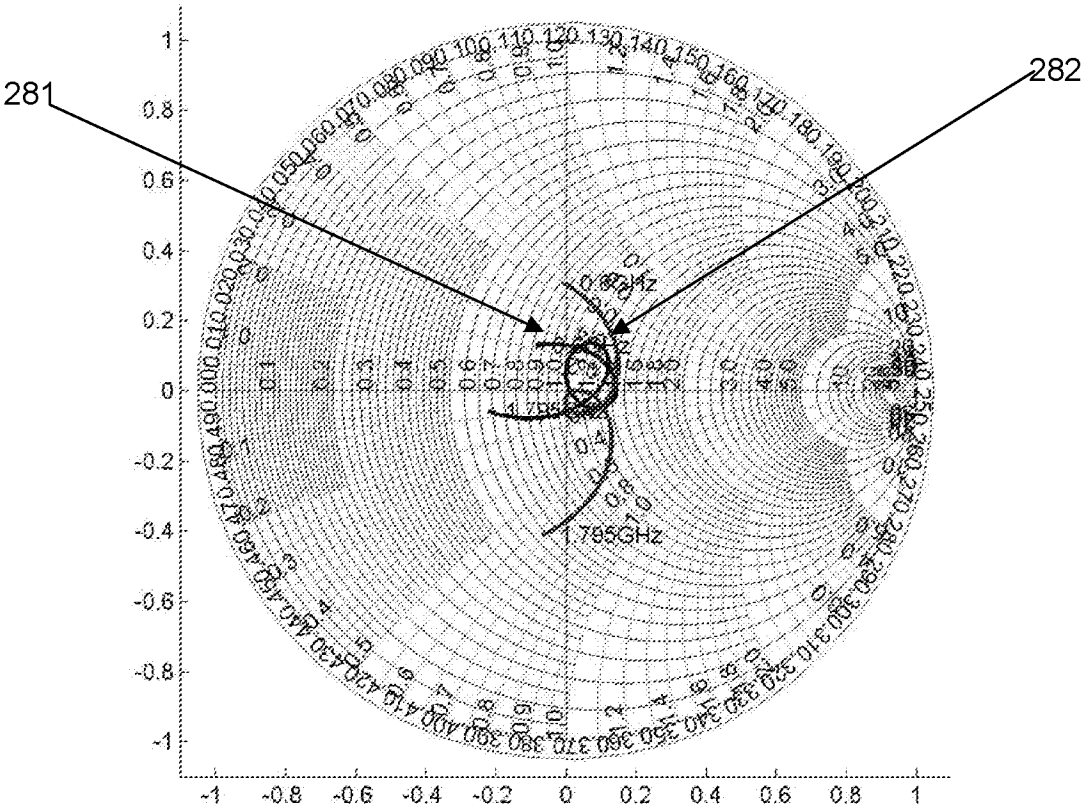
FIG. 28 illustrates a Smith chart of the effective antenna impedance $Z_B$ plotted where the reference impedance at the centre of the chart is $Z_0$. The effective antenna impedance $Z_B$ is the series combination of $Z_{BB}$ and the capacitance C2=1.2 pF and inductance L2=25 nH.

Illustrated in FIG. 28, the magnitude of the reactance of the impedance $Z_{BB}$ (282) can be decreased by adding series capacitance C2 and inductance L2, giving the effective antenna impedance $Z_B$ 281. The added capacitance and inductance predominantly add capacitive and inductive reactance at frequencies below and above $f_0$ respectively. Good matching to the load circuits is then obtained by increasing the load impedance $Z_L$ so as to equal $Z_0$.

Figure 29:
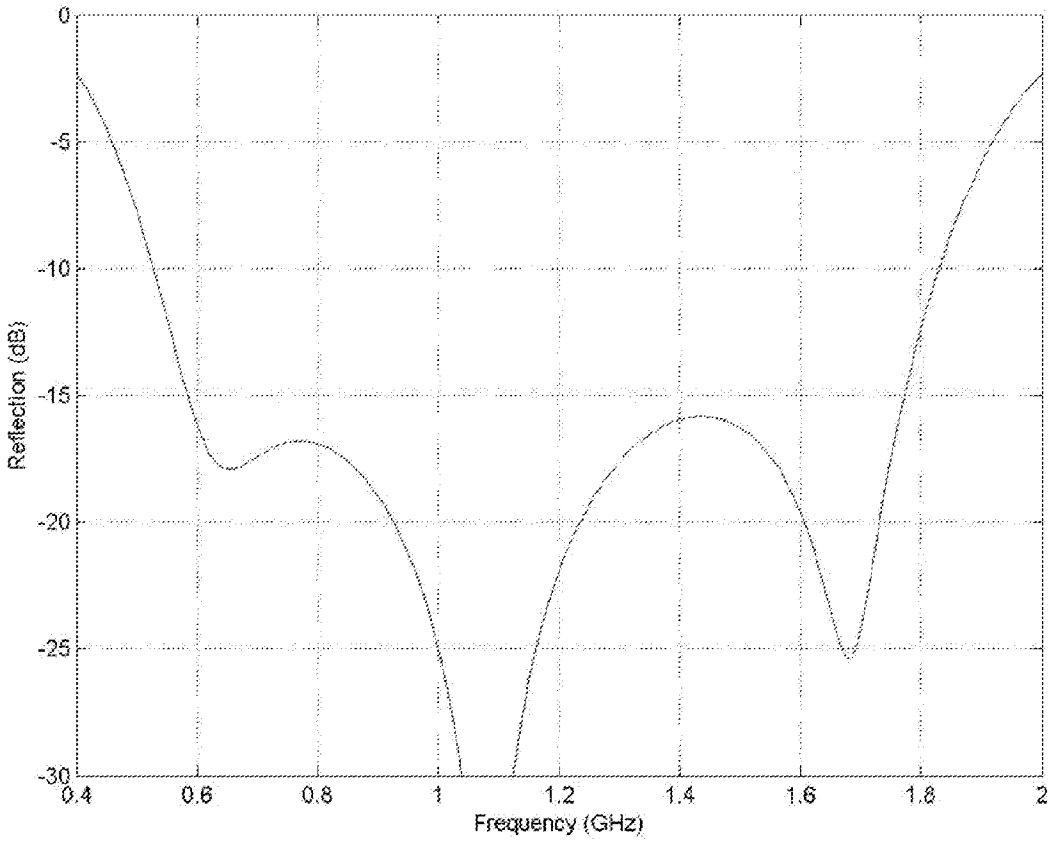
FIG. 29 illustrates the reflection coefficient corresponding to the effective antenna impedance of FIG. 28.

FIG. 29 illustrates the resulting reflection coefficient corresponding to the effective antenna impedance of FIG. 28.

It can be seen that through redesign of the array including matching impedances at low and high frequencies, improved results can be obtained.

Figure 30:
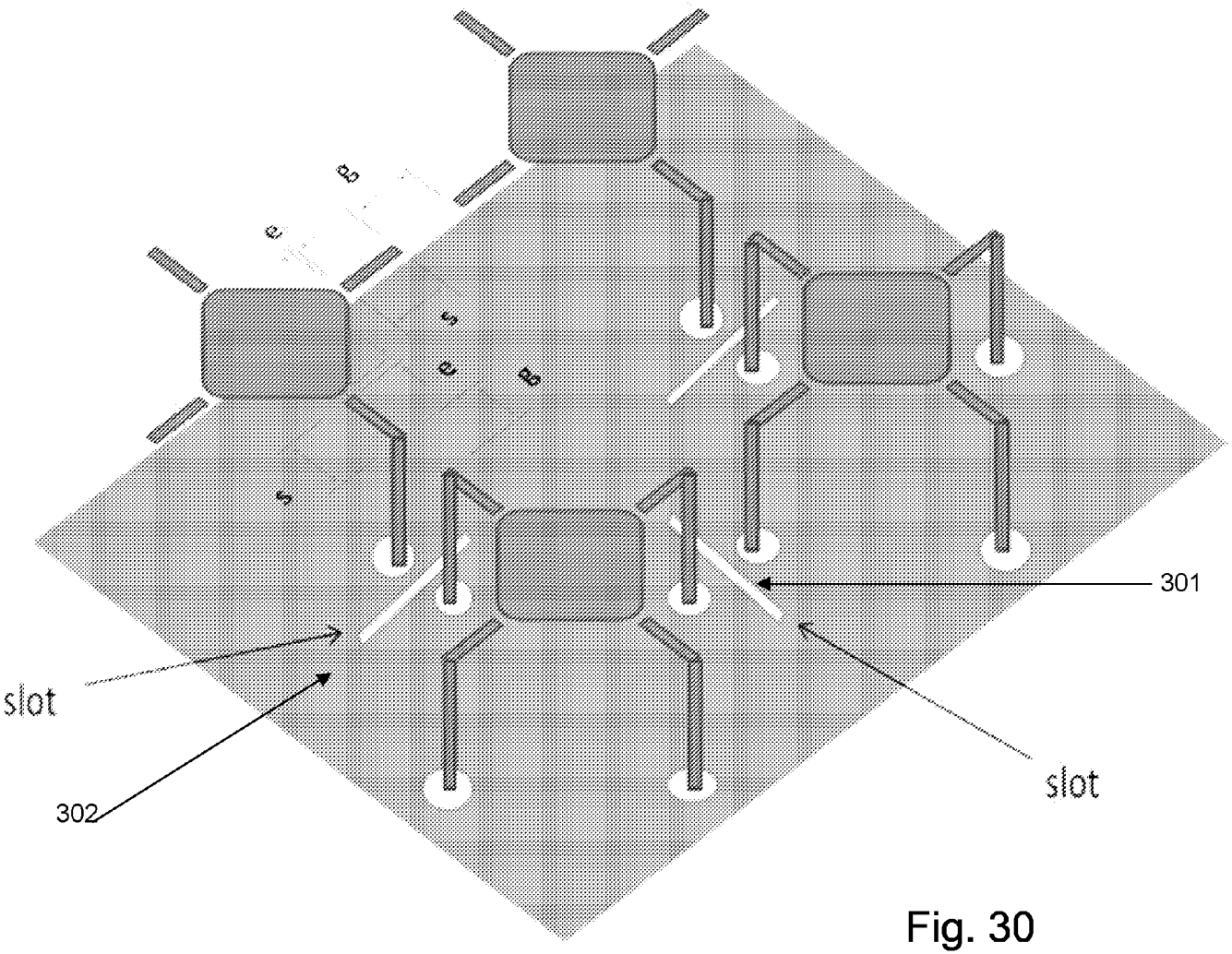
FIG. 30 illustrates an alternative arrangement having low loss series inductance formed in the ground plane by means of a series of slots.
Figure 32:
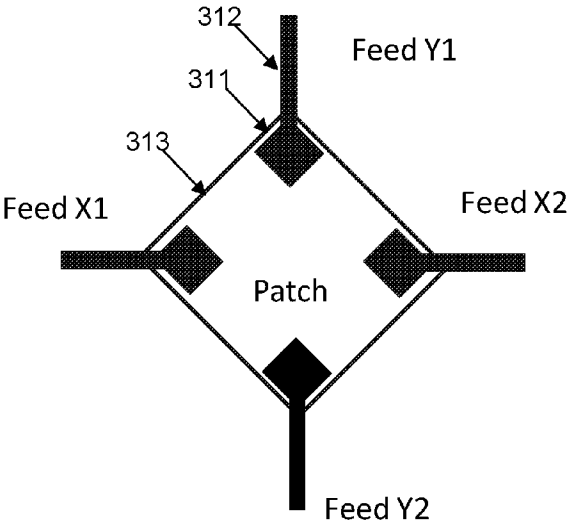
FIG. 32 illustrates a top plan view of the arrangement of FIG. 31.

It will be evident that many variations are possible. For example, other techniques can be utilized to provide for implementation of series inductances etc. For example, instead of the slot approach of FIG. 17, slots or other modifications can be made to the ground plane. An example of a modified arrangement is illustrated in FIG. 30 wherein a series of slots 301, 302 are placed in the ground plane in order to provide a low loss series inductance in the equivalent circuit.

Figure 33:
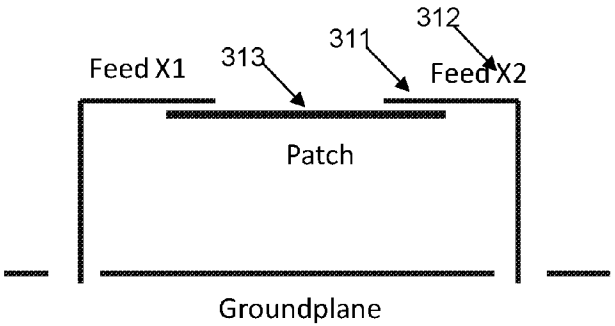
FIG. 33 illustrates a side sectional view through the arrangement of FIG. 31.
Figure 31:
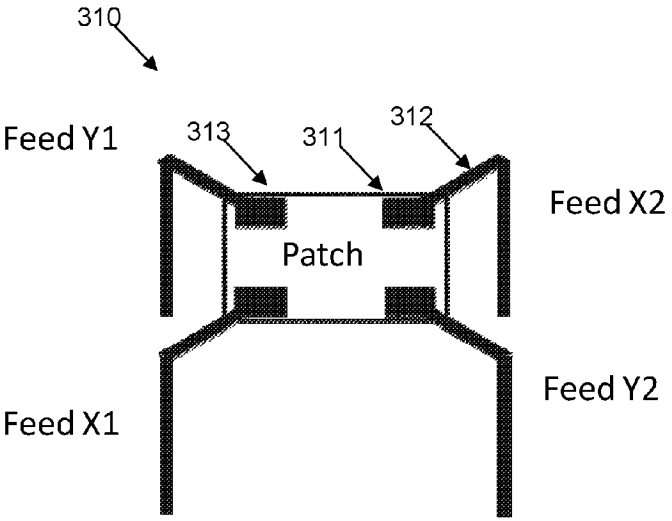
FIG. 31 illustrates a schematic side perspective view of an alternative form of array element.

Further modified embodiments are possible. For example, depending on requirements, various modifications can be made to the patches and feed in arrangement to modify desirable impedance and capacitances in the series arrangement. For example, in FIG. 31, there is illustrated an alternative feed line and patch arrangement 310. In this arrangement, the patch 313 is electromagnetically coupled to a series of feeds e.g. 312. The thickness of each feed line is profiled via simulation to provide for a tunable inductance. The feed lines include a series of tabs e.g. 311, which are offset from the patches e.g. 313. The tabs provide for a selectively tunable capacitance between the tab and patch. Thorough extensive simulation, the size of the tabs can be adjusted to improve impedance matching properties. The tabs can be formed above (FIG. 33) or below the patches.

It will be understood that the advantages outlined in the antenna arrangement apply both in the transmission and reception operational modes.

Interpretation

The following description and figures make use of reference numerals to assist the addressee understand the structure and function of the embodiments. Like reference numerals are used in different embodiments to designate features having the same or similar function and/or structure.

The drawings need to be viewed as a whole and together with the associated text in this specification. In particular, some of the drawings selectively omit including all features in all instances to provide greater clarity about the specific features being described. While this is done to assist the reader, it should not be taken that those features are not disclosed or are not required for the operation of the relevant embodiment.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, Fig., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention. In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

I claim:

1. An antenna device including:

a ground plane including a first surface;

an array of spaced apart conductive antenna patches arranged substantially along a second surface that is parallel to and offset from said first surface;

a series of pairs of conductive feed interconnections, each pair of conductive feed interconnections being associated with a particular polarization state, connected to a respective drive circuit and capacitively coupled to a corresponding conductive patch of the spaced apart array of conductive antenna patches thereby to provide a capacitive coupling between the respective conductive antenna patches and corresponding driving circuits to electrically drive the conductive antenna patches at the particular polarization state, said conductive feed interconnections projecting through respective apertures of said ground plane and being profiled to provide a complementary series inductance to said capacitive coupling so as to thereby improve the impedance matching of the conductive feed interconnections and conductive antenna patches.

2. An antenna device as claimed in claim 1 wherein the antenna device operates over a predetermined frequency range and the reactance of the conductive feed and conductive patch interconnection is negative at low operational frequencies and positive at high operational frequencies and zero at an intermediate frequency.

3. An antenna device as claimed in claim 1 wherein said conductive feed interconnections are arranged into two sets of orthogonal polarizations for feeding corresponding conductive patches in a polarization orthogonal manner.

4. An antenna device as claimed in claim 3 wherein conductive feed interconnections from orthogonal polarizations are spaced apart when coupled to said patches.

5. An antenna device as claimed in claim 4 wherein the conductive feed interconnections of each set form a first and second grid with the first grid being offset relative to the second grid by substantially a half grid period.

6. An antenna device as claimed in claim 1 wherein the conductive feed interconnections include an elongated portion substantially parallel to a surface of any adjacent conductive patches and wherein said elongated portion is substantially parallel to the second surface.

7. An antenna device as claimed in claim 6 wherein said elongated portion includes a capacitive plate portion overlapping the conductive patch to provide controlled capacitive coupling thereto.

8. An antenna device as claimed in claim 7 wherein said capacitive plate portion comprises an end portion of the conductive feed.

9. An antenna device as claimed in claim 8 wherein said conductive feed interconnections are surrounded by a shield adjacent said first conductive extended body, said shield reducing the common mode current or enhancing the differential mode current of the conductive surrounded feed interconnections between the first surface and the conductive patches.

10. An antenna device as claimed in claim 9 wherein said shield is conductively interconnected to said first conductive extended body.

11. An antenna device as claimed in claim 1 wherein said conductive patches and said conductive feed interconnections are separated by a small non conductive gap.

12. An antenna device as claimed in claim 1 wherein said conductive feed interconnections form the closest electromagnetic coupling with the conductive patches at the corners of the conductive patches.

13. An antenna device as claimed in claim 1 wherein the effective length of the conductive feed interconnections is shortened by a conductive unit interconnected to said first conductive extended body structure in the area adjacent said first conductive extended body structure.

14. An antenna device as claimed in claim 13 wherein said conductive unit is of a generally boxed form having a slot in one surface thereof between said pairs.

15. An antenna device as claimed in claim 1 wherein said first conductive extended body structure includes a series of slots in the surface there of.

16. An antenna device according to claim 1, wherein two pairs of conductive feed interconnections are connected to each conductive antenna patch, each pair being configured for feeding the conductive antenna patch in an orthogonal polarization.

* * * * *